US008190066B2

(12) United States Patent
Sakuma

(10) Patent No.: US 8,190,066 B2
(45) Date of Patent: May 29, 2012

(54) DEVELOPING UNIT

(75) Inventor: Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 801 days.

(21) Appl. No.: 12/234,078

(22) Filed: Sep. 19, 2008

(65) Prior Publication Data

US 2009/0116877 A1 May 7, 2009

(30) Foreign Application Priority Data

Nov. 7, 2007 (JP) ..... 2007-289756

(51) Int. Cl.
*G03G 15/08* (2006.01)

(52) U.S. Cl. ..... 399/258; 399/106

(58) Field of Classification Search ..... 399/102, 399/103, 105, 106, 258, 262
See application file for complete search history.

(56) References Cited

U.S. PATENT DOCUMENTS

| | | | | |
|---|---|---|---|---|
| 5,890,034 | A * | 3/1999 | Nakano et al. | 399/106 |
| 6,438,345 | B1 * | 8/2002 | Ban et al. | 399/262 |
| 2002/0039502 | A1 * | 4/2002 | Matsumoto et al. | 399/258 |
| 2002/0064401 | A1 | 5/2002 | Ashikari | |
| 2003/0091371 | A1 | 5/2003 | Wang et al. | |
| 2006/0104671 | A1 | 5/2006 | Murakami et al. | |
| 2007/0071503 | A1 * | 3/2007 | Sato | 399/258 |
| 2007/0223971 | A1 * | 9/2007 | Takagi | 399/258 |
| 2008/0124105 | A1 * | 5/2008 | Okamoto et al. | 399/51 |
| 2008/0267658 | A1 * | 10/2008 | Takagi et al. | 399/106 |

FOREIGN PATENT DOCUMENTS

| | | | |
|---|---|---|---|
| EP | 1041454 | A1 | 10/2000 |
| EP | 1840666 | A1 | 10/2007 |
| JP | 60-131571 | | 7/1985 |
| JP | 09-319202 | | 12/1997 |
| JP | 2004-170747 | A | 6/2004 |
| JP | 2004-258472 | A | 9/2004 |
| JP | 2006-163374 | | 6/2006 |

OTHER PUBLICATIONS

Extended EP Search Report and Search Opinion mailed May 6, 2010, EP Appln. 08015235.8.

* cited by examiner

*Primary Examiner* — David Gray
*Assistant Examiner* — Rodney Bonnette
(74) *Attorney, Agent, or Firm* — Banner & Witcoff, Ltd.

(57) ABSTRACT

A developing unit includes a developer cartridge having an outside frame and an inside frame that has a first opening. The first opening is movable between a first opening position where the first opening is opened and a first closing position where the first opening is closed by the outside frame. The developing unit further includes a first seal disposed around the first opening on the inside frame, a housing that includes a cartridge holding part for holding the developer cartridge and is capable of holding a developer holding member, and a capturing member which is provided on the cartridge holding part. The capturing member has a developer capturing force greater than that of the first seal, and is slide contactable with the first seal when the inside frame moves from the first opening position to the first closing position.

17 Claims, 15 Drawing Sheets

UPPER SIDE
FRONT SIDE
LEFT SIDE
LOWER SIDE
RIGHT SIDE
BACK SIDE
31

DEVELOPING UNIT

CROSS-REFERENCE TO RELATED APPLICATIONS

This application claims priority from Japanese Patent Application No. 2007-289756 filed on Nov. 7, 2007, the entire subject matter of which is incorporated herein by reference.

TECHNICAL FIELD

Aspects of the present invention relate to a developing unit of an image forming apparatus.

BACKGROUND

For example, in a developing device disclosed in JP-A-9-319202 as a developing unit, a developer cartridge housing a developer is detachably attached to a frame provided with a developing part having a developing roller. In the developing device, a developer supply port is formed by a hole formed in one side of the developer cartridge and a hole formed in the frame of the developing device, and a developer absorbing port is formed by a hole formed in the other side of the developer cartridge and a hole formed in the frame.

The developer in the developer cartridge is supplied to the developing part in the frame through the developer supply port and some developer is returned to the developer cartridge through the developer absorbing port. Accordingly, the developer can be circulated between the developing part and the developer cartridge.

SUMMARY

Aspects of the invention provide a developing unit capable of improving usability.

According to an aspect of the invention, there is provided a developer unit comprising: a developer cartridge comprising: an outside frame; and an inside frame that comprises a first opening and is movable between a first opening position where the first opening is opened and a first closing position where the first opening is closed by the outside frame; a first seal disposed around the first opening on the inside frame; a housing that comprises a cartridge holding part for holding the developer cartridge and is capable of holding a developer holding member; and a capturing member which is provided on the cartridge holding part, which has a developer capturing force greater than that of the first seal, and which is slide contactable with the first seal when the inside frame moves from the first opening position to the first closing position.

According to the aspect of the invention, by allowing the cartridge holding part to hold the developer cartridge and disposing the inside frame at the first opening position, the first opening is opened. Accordingly, it is possible to supply the developer accommodated in the developer cartridge to the developer holding member of the housing through the opened first opening. Further, since the first opening is closed by disposing the inside frame at the first closing position, it is possible to detach the developer cartridge from the housing with preventing leakage of the developer from the developer cartridge.

Herein, the first seal is disposed around the first opening on the inside frame. Accordingly, when the inside frame is located at the first opening position, it is possible to prevent the developer accommodated in the developer cartridge from not being supplied to the developer holding member but leaking from the first opening.

The developer can be easily attached to the first seal. However, when the inside frame moves from the first opening position to the first closing position, the capturing member having a developer capturing force greater than that of the first seal comes in sliding contact with the first seal. Accordingly, the developer attached to the first seal is captured by the capturing member during movement of the inside frame. As a result, until the inside frame reaches the first closing position, the developer attached to the first seal is removed without being attached to the outside frame. Accordingly, even when a user accesses the outside frame to detach the developer cartridge from the housing, it is possible to prevent the user's hand from being contaminated by the developer.

According thereto, usability can be improved.

DETAILED DESCRIPTION

In the related developing device disclosed in JP-A-9-319202, the developer cartridge may be configured to have an outside frame and an inside frame movable relative to the outside frame and accommodating the developer. It can be considered that the holes forming the developer supply port and the developer absorbing port are formed on the inside frame and seals are disposed to surround the holes. The inside frame can move along with the seals between an opening position where the holes are opened and a closing position where the holes are closed by the outside frame. When the inside frame is located at the opening position, the seals are exposed to the outside along with the holes. When the inside frame is located at the closing position, the seals are disposed between the inside frame and the outside frame to prevent the developer from leaking between the inside frame and the outside frame from the holes.

In this case, in a state where the developer cartridge is attached to the frame of the developing device and the inside frame is located at the closing position, the seals surround the holes forming the developer supply port and the developer absorbing port in the frame of the developing device, thereby plugging gaps between the frame of the developing device and the developer cartridge (inside frame) around the developer supply port and the developer absorbing port. Accordingly, since the developer passes through spaces surrounded with the seals around the developer supply port and the developer absorbing port, the developer moves between the developing part and the developer cartridge (inside frame) without leaking.

Here, for example, when the inside frame is made to move from the opening position and the closing position to detach the developer cartridge from the frame of the developing device, the seals cross the holes of the frame of the developing device and thus the developer in the holes in the frame may be attached to the seals. When the seals come in contact with the outside frame with the movement of the inside frame from the opening position to the closing position, the developer attached to the seals may be attached to the outside frame. When a user accesses the outside frame in this state to detach the developer cartridge from the frame of the developing device, the user's hand may be contaminated with the developer attached to the outside frame. Thus, usability may be deteriorated.

Aspects of the invention provide a developing unit capable of improving usability.

Exemplary embodiments of the present invention will be described with reference to the drawings.

(Image Forming Apparatus)

Figure 1:
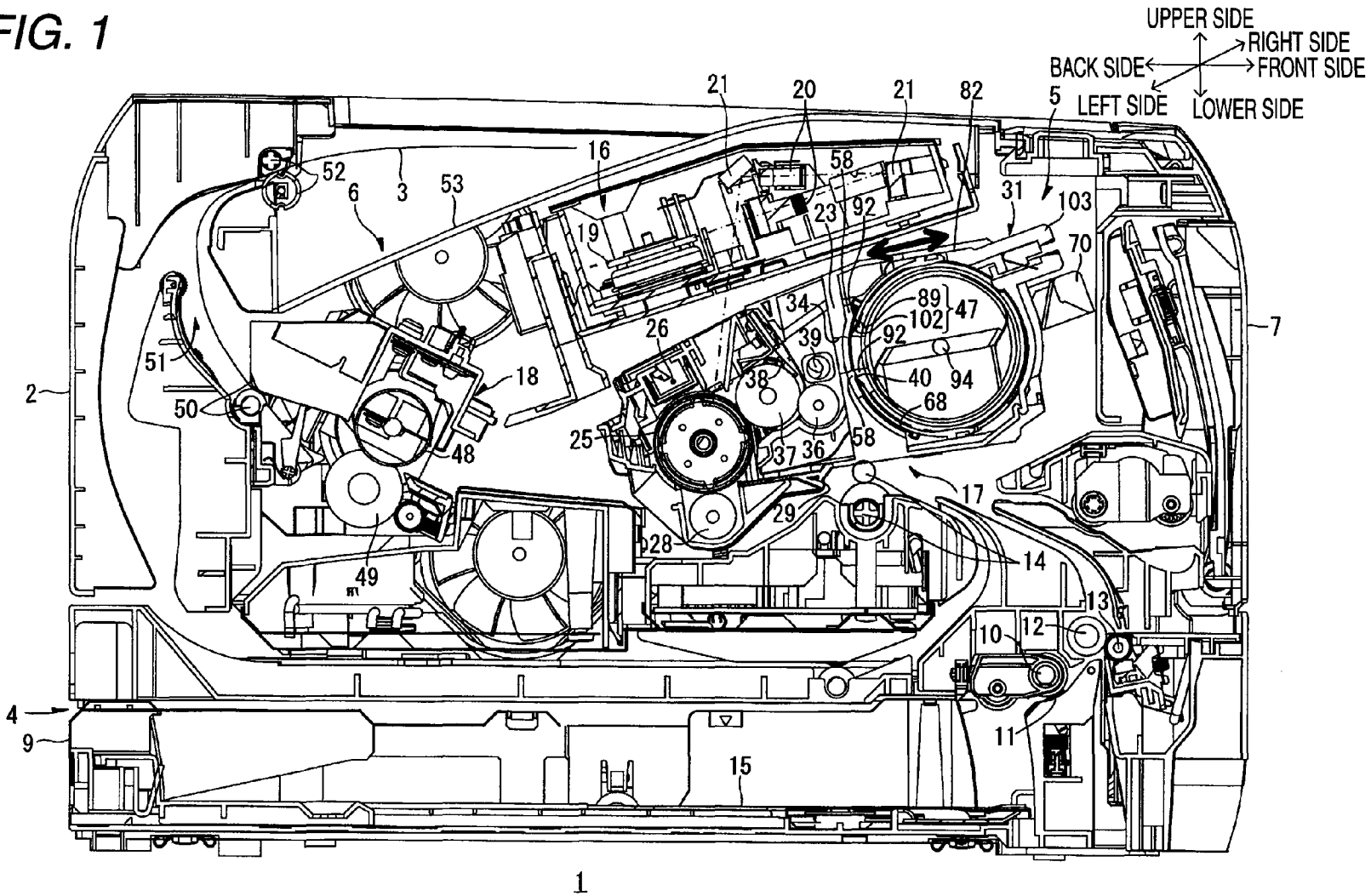
FIG. 1 is a left side sectional view showing an image forming apparatus according to the invention.

Referring to FIG. 1, an image forming apparatus 1 includes a feeder unit 4 feeding a sheet 3 to a body casing 2, an image forming unit 5 forming an image on the fed sheet 3, and a sheet discharge unit 6 discharging the sheet 3 having an image formed thereon.

(1) Body Casing

The body casing 2 has a box shape, where an opening is formed in one side wall and a front cover 7 opening and closing the opening is provided. By opening the front cover 7, a process cartridge 17 (which will be described later) as an example of the developing unit is attachable to and detachable from the body casing 2 in the direction indicated by a bold line.

In the following description, it is assumed that a side provided with the front cover 7 is a front side (front surface side) and the opposite side is a rear side (rear surface side). The front side in the paper thickness direction of FIG. 1 a left side and the depth side in the paper thickness direction of FIG. 1 is a right side. The lateral direction is equal to the width direction. The horizontal direction includes the front-rear direction and the lateral direction and the vertical direction includes the up-down direction. In describing the process cartridge 17 to be described later and a developer cartridge 31 as an example of the developer cartridge, it is based on a state where a frame-side passage hole 34 (which will be described later) as an example of the second opening and a cartridge-side passage hole 47 (which will be described later) are opposed to each other substantially in the horizontal direction (front-rear direction).

(2) Feeder Unit

The feeder unit 4 includes a sheet feed tray 9, a feed roller 10, a feed pad 11, paper dust removing rollers 12 and 13, a registration roller 14, and a sheet pressing plate 15. The sheet 3 located at the uppermost of the sheet pressing plate 15 is sent to the feed roller 10 and the feed pad 11 sheet by sheet, passes through the rollers 12 to 14, and then is conveyed to a transfer position (which will be described later) of the image forming unit 5.

(3) Image Forming Unit

The image forming unit 5 includes a scanner unit 16, a process cartridge 17, and a fixing part 18.

(3-1) Scanner Unit

The scanner unit 16 is disposed in an upper portion of the body casing 2 and includes a laser emitting part (not shown), a polygon mirror 19 rotationally driven, plural lenses 20, and plural reflecting mirrors 21. As indicated by a one-dot chained line, a laser beam emitted from the laser emitting part based on image data is reflected by the polygon mirror 19, is transmitted or reflected by the plural lenses 20 and the plural reflecting mirrors 21, and is applied to the surface of a photosensitive drum 25 (which will be described later) of the process cartridge 17.

(3-2) Process Cartridge

The process cartridge 17 is housed in a space below the scanner unit 16 in the body casing 2 and is detachably attached to the body casing 2.

Figures 2A, 2B:
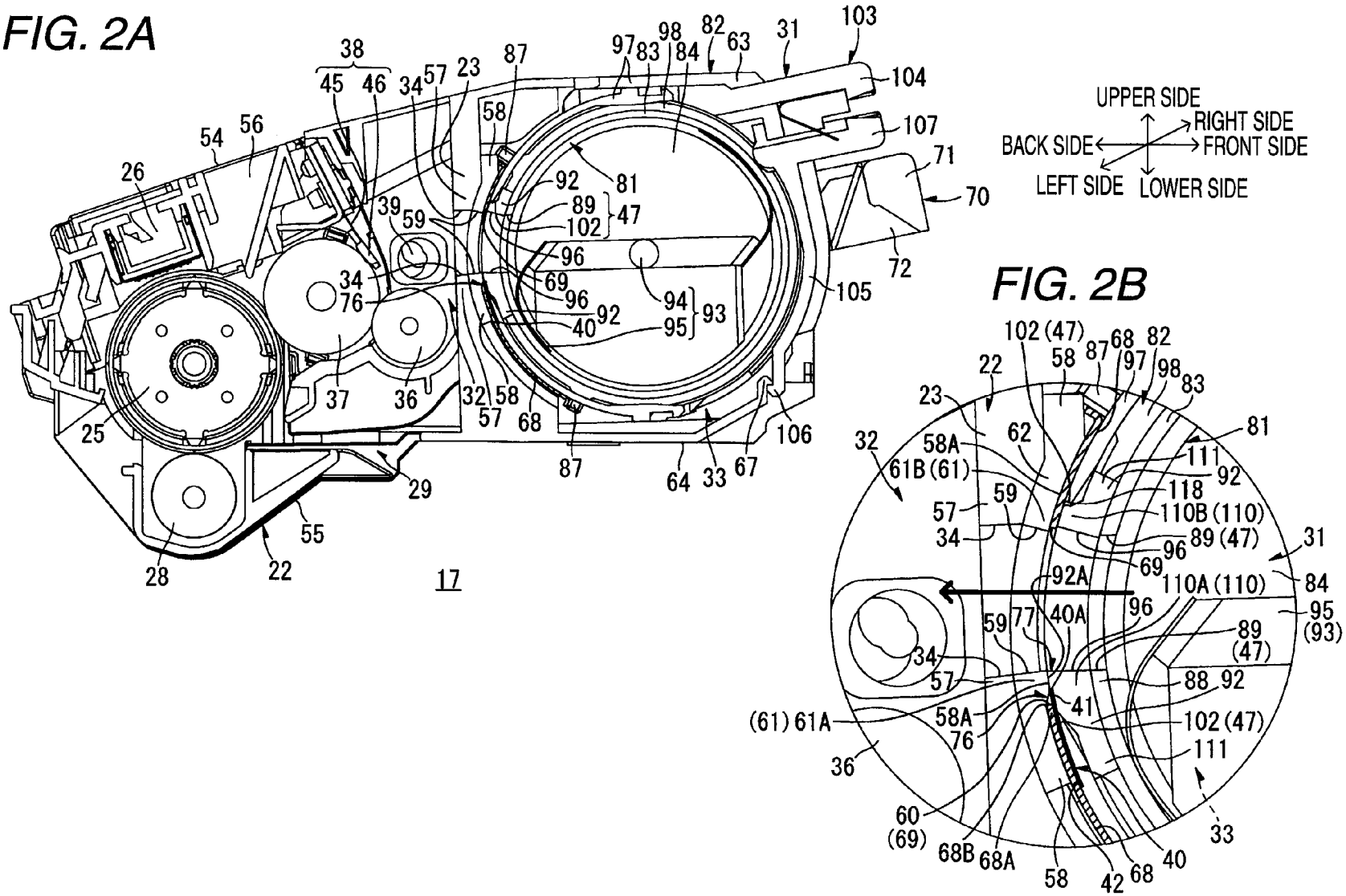
FIG. 2A is a left side sectional view of a process cartridge of the image forming apparatus, showing a state where a developer cartridge is attached and a swing arm is located at a pressing position.
FIG. 2B is a partial enlarged view of FIG. 2A.

As shown in FIGS. 2A and 2B, the process cartridge 17 includes a hollow process frame 22 having a transfer path 29 allowing the passage of the sheet 3 and a developer cartridge 31 detachably attached to a cartridge holding part 33 (which will be described later) of the process frame 22. The process frame 22 serves as an example of the housing.

Substantially at the center position in the front-rear direction of the process frame 22, a partition wall 23 extending in the vertical direction is disposed. In the inside space of the process frame 22, the rear side of the partition wall 23 serves as a developing part 32 and the front side of the partition wall 23 serves as the cartridge holding part 33. A frame-side passage hole 34 is formed in the partition wall 23. The developing part 32 and the cartridge holding part 33 communicate with each other through the frame-side passage hole 34.

A photosensitive drum 25, a scorotron-type charger 26, a transfer roller 28, a supply roller 36, a developing roller 37, a thickness regulating blade 38, and an auger 39 are disposed in the developing part 32. The photosensitive drum 25, the transfer roller 28, the supply roller 36, the developing roller 37, and the auger 39 are rotatably supported by the process frame 22. The developing roller 37 serves as an example of the developer holding member.

The scorotron-type charger 26 is supported above the photosensitive drum 25 by the process frame 22 with a gap from the photosensitive drum 25. The transfer roller 28 is oppositely disposed below the photosensitive drum 25. The developing roller 37 is oppositely disposed in front of the photosensitive drum 25. The supply roller 36 is oppositely disposed in front of the developing roller 37. The thickness regulating blade 38 includes a thin-plate leaf spring member 45 of which the upper end is fixed to the process frame 22 and a pressing rubber 46 disposed at the lower end of the leaf spring member 45 to press the surface of the developing roller 37 with an elastic force of the leaf spring member 45. The auger 39 includes a shaft extending in the width direction and a spiral blade formed on the outer circumferential surface of the shaft and is disposed above the supply roller 36 and in back of the frame-side passage hole 34.

The developer cartridge 31 is detachably attached to the process frame 22 and is held in the cartridge holding part 33 at the time of attaching. The developer cartridge 31 has a substantially cylindrical shape. A cartridge-side passage hole 47 allowing the inside to communicate with the outside is formed in the developer cartridge 31.

An agitator 93 is rotatably disposed in the developer cartridge 31. A positively chargeable, non-magnetic one component toner as an example of the developer is accommodated in the developer cartridge 31. The average particle size (diameter) of the developer is about in the range of 6 to 10 μm.

The developer in the developer cartridge 31 is agitated with the rotation of the agitator 93 and is supplied into the developing part 32 from the cartridge-side passage hole 47 through the frame-side passage hole 34. Thereafter, the developer is conveyed in the width direction by the rotating auger 39, drops in the middle way, and is supplied to the supply roller 36.

Then, the developer supplied to the supply roller 36 is supplied to the developing roller 37 with the rotation of the supply roller 36. At this time, the developer is positively charged between the supply roller 36 and the developing roller 37. Subsequently, the developer supplied to the developing roller 37 enters between the pressing rubber 46 and the developing roller 37 with the rotation of the developing roller 37, is regulated in thickness therebetween, and is held as a thin layer on the surface of the developing roller 37. The developer is positively charged with the friction at the time of entering between the pressing rubber 46 and the developing roller 37.

The surface of the photosensitive drum 25 is first positively and uniformly charged by the scorotron-type charger 26 with the rotation of the photosensitive drum 25 and then is exposed to the laser beam from the scanner unit 16. Accordingly, an electrostatic latent image based on image data is formed on the surface of the photosensitive drum 25. Then, with the rotation of the developing roller 37, the developer held on the surface of the developing roller 37 is supplied to the electrostatic latent image formed on the surface of the photosensitive drum 25 at the time of coming in contact with the photosensitive drum 25. Accordingly, the electrostatic latent image is developed (visualized) and a developer image is held on the surface of the photosensitive drum 25. The developer image is transferred onto the sheet 3 passing between the photosensitive drum 25 and the transfer roller 28 (transfer position) in the transfer path 29.

(3-3) Fixing Part

The fixing part 18 is disposed in back of the process cartridge 17 as shown in FIG. 1. The fixing part 18 includes a heating roller 48, a pressurizing roller 49 pressed against the heating roller 48 from the downside, and a pair of conveyance rollers 50 disposed in the back thereof.

The fixing part 18 thermally fixes the developer transferred onto the sheet 3 at the transfer position while the sheet 3 passes between the heating roller 48 and the pressurizing roller 49. Thereafter, the sheet 3 is conveyed to a sheet discharge part 6 by the pair of conveyance rollers 50.

(4) Sheet Discharge Part

The sheet discharge part 6 includes a discharge path 51, a discharge roller 52, and a sheet discharge tray 53. The sheet 3 fed from the fixing part 18 to the sheet discharge part 6 is fed from the discharge path 51 to the discharge roller 52 and is discharged onto the sheet discharge tray 53 by the discharge roller 52.

(Process Frame)

Figures 3A, 3B:
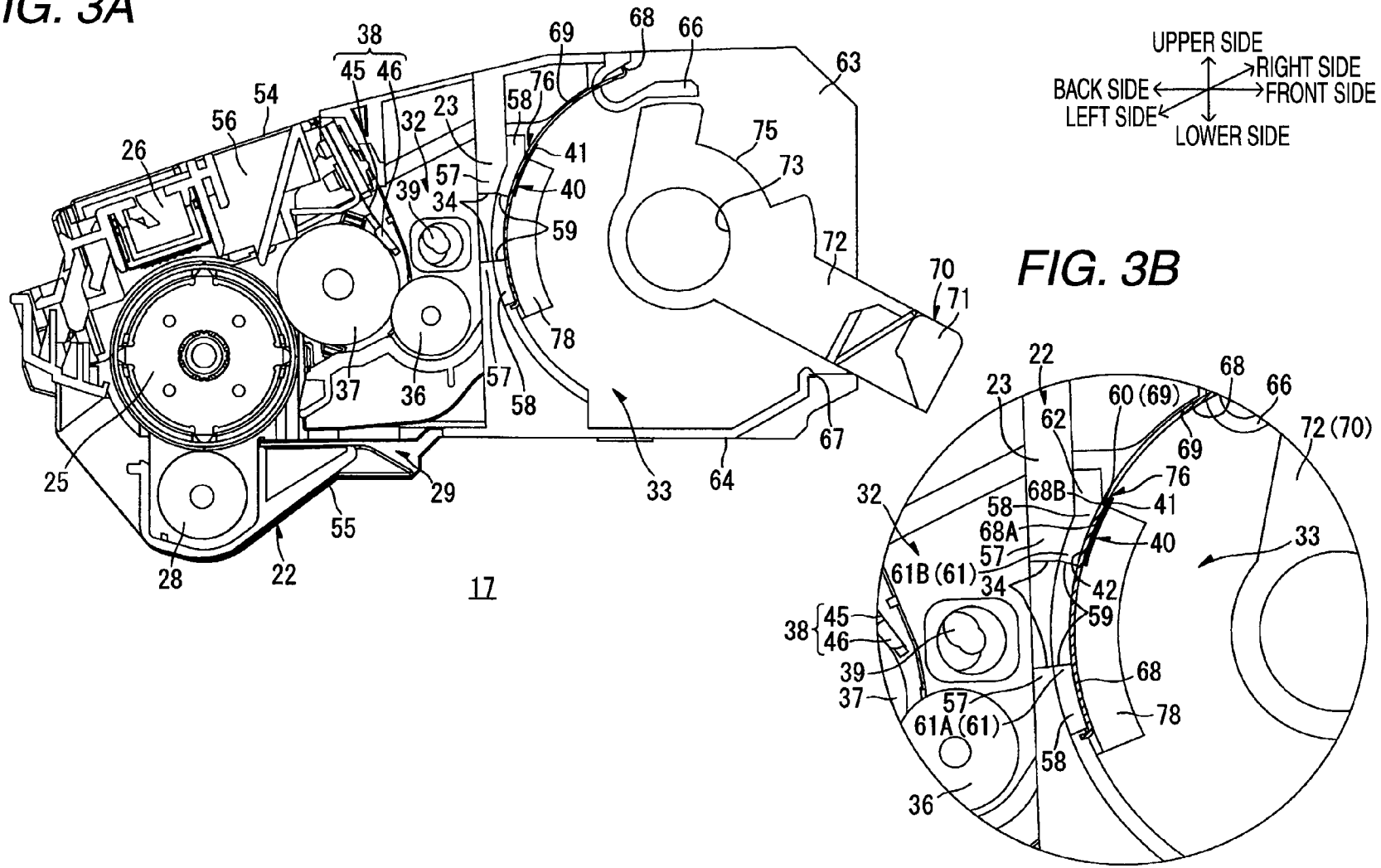
FIG. 3A is a left side sectional view of the process cartridge, showing a state where the developer cartridge is detached and the swing arm is located at a press releasing position.
FIG. 3B is a partial enlarged view of FIG. 3A.
Figure 4:
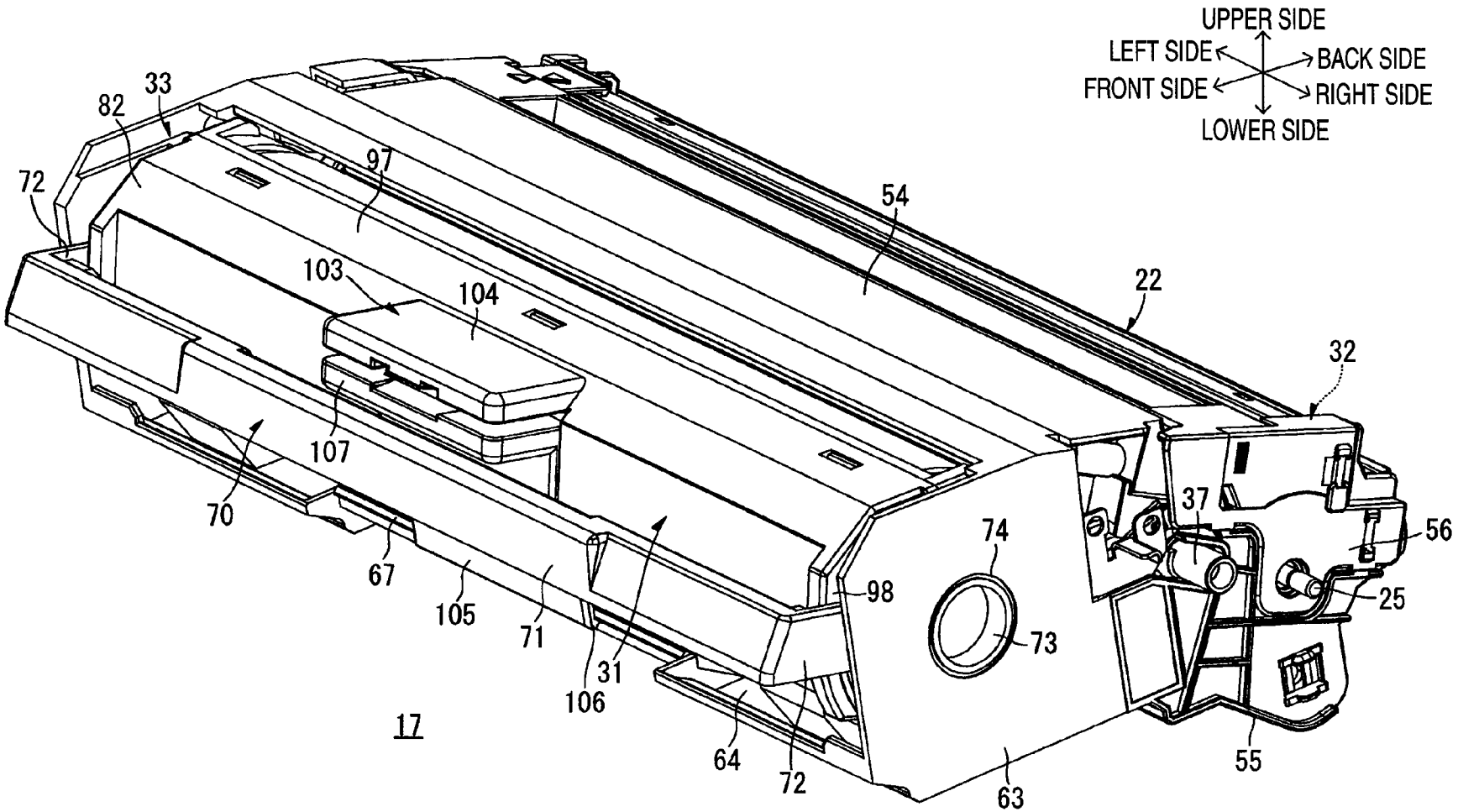
FIG. 4 is a perspective view of the process cartridge shown in FIGS. 2A and 2B as viewed obliquely from a front-right side.
Figure 5:
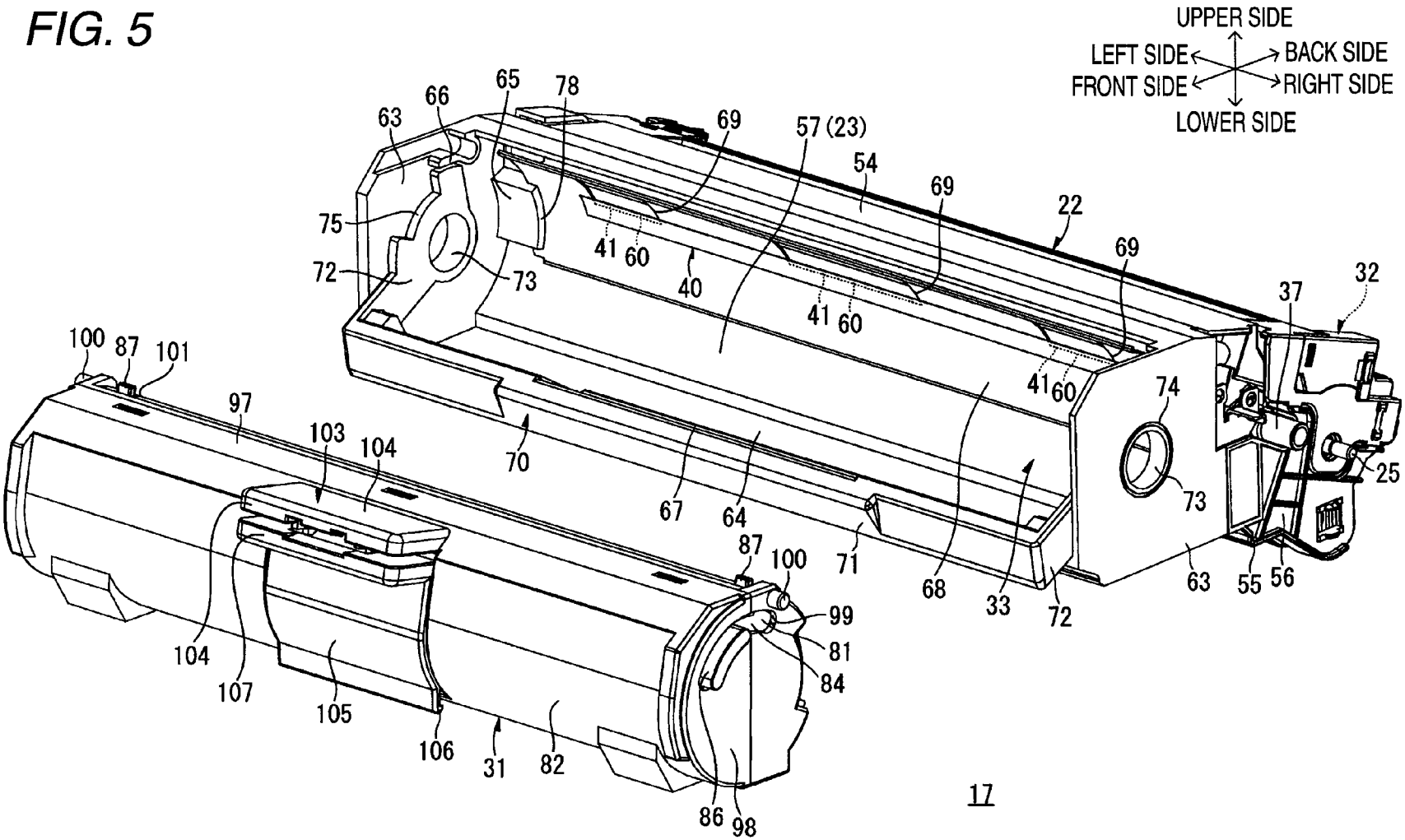
FIG. 5 is an exploded perspective view of the process cartridge as viewed obliquely from the front-right side.
Figure 6:
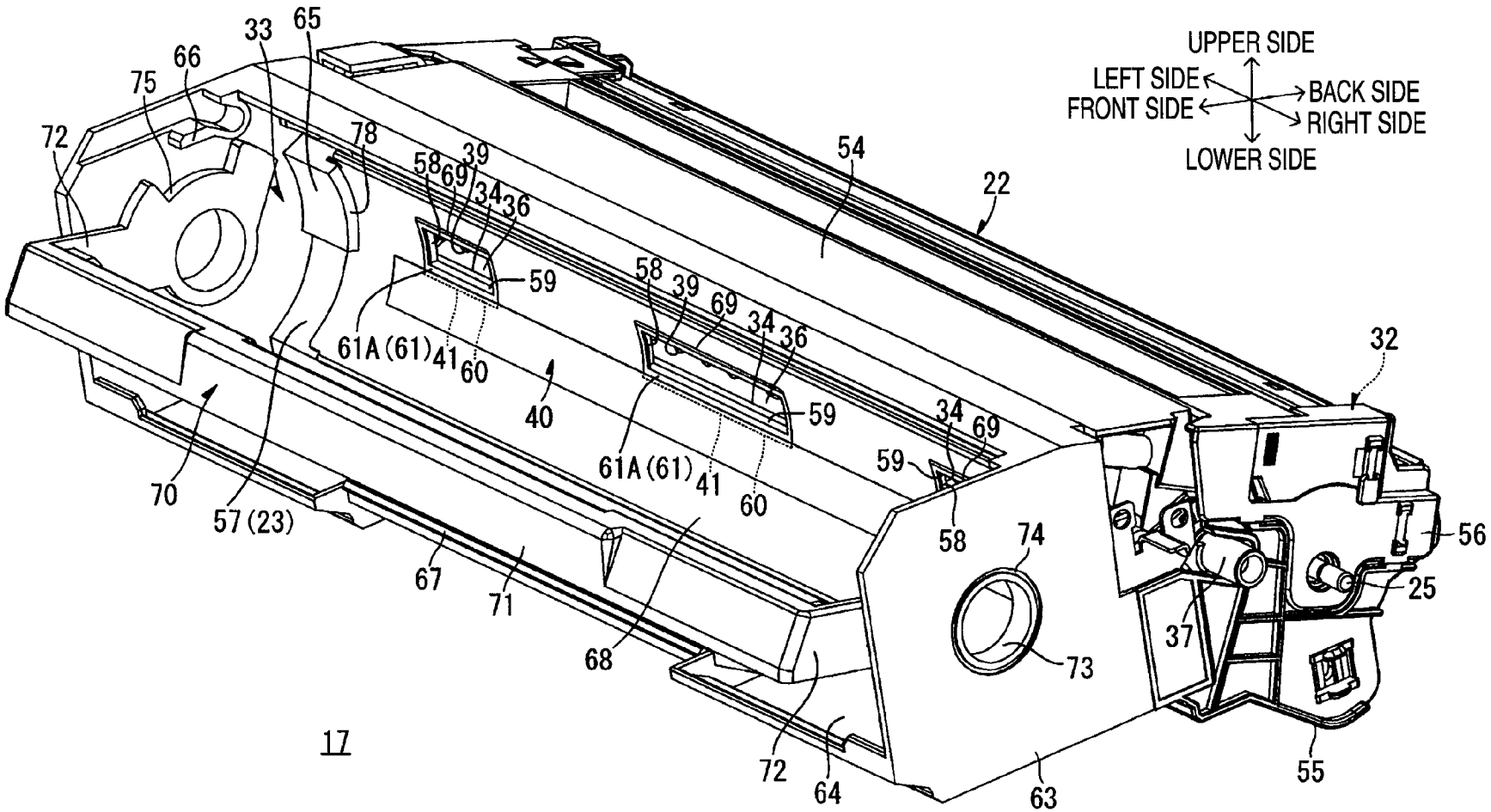
FIG. 6 is a diagram showing a state where the process cartridge is omitted from FIG. 4.

FIG. 3A a left side sectional view showing a process cartridge (in a state where the developer cartridge is detached and the swing arm is located at the press releasing position) of the image forming apparatus shown in FIG. 1 and FIG. 3B is a partial enlarged view of FIG. 3A. FIG. 4 is a perspective view of the process cartridge shown in FIG. 2A as viewed obliquely from the front left side. FIG. 5 is an exploded perspective view of the process cartridge as obliquely viewed from the front right side. FIG. 6 is a perspective view in which the process cartridge is omitted from FIG. 4.

(1) Process Frame

As shown in FIGS. 3A and 3B, the developing part 32 and the cartridge holding part 33 are formed in the process frame 22.

(1-1) Developing Part

As shown in FIGS. 3A, 3B and 4, the developing part 32 is a space by a top wall 54, a bottom wall 55, both side walls 56, and the above-mentioned partition wall 23. Both side walls 56 extend in the front-rear direction and are disposed opposite to each other with a gap therebetween in the width direction.

As shown in FIGS. 2A and 2B, a curved portion 57 is formed in the middle way in the vertical direction of the partition wall 23. The front side surface of the curved portion 57 is smoothly depressed backward along the outer circumferential surface of the developer cartridge 31. The frame-side passage hole 34 is formed in the curved portion 57. As shown in FIG. 6, three frame-side passage holes 34 are formed with a gap in the width direction. The frame-side passage holes 34 have substantially rectangular shapes longitudinal in the width direction and face the cartridge holding part 33.

As shown in FIGS. 3A and 3B, a frame seal 58 for preventing the leakage of the developer from the frame-side passage hole 34 to the cartridge holding part 33 is bonded to the front side surface of the curved portion 57. The frame seal 58 serves as an example of the capturing member and the second seal. The frame seal 58 is formed a band shape extending in the width direction out of an elastic foamed material (product name: SM-55 made by INOAC Corporation). Three cutout portions 59 are formed with a gap in the width direction to correspond to the frame-side passage holes 34. The cutout portions 59 are through holes having substantially the same size as the corresponding frame-side passage holes 34 and communicate with the corresponding frame-side passage holes 34 from the front side. In this state, the frame seal 58 is disposed around the frame-side passage holes 34 so that the cutout portions 59 surround the corresponding frame-side passage holes 34, and protrudes into the cartridge holding part 33. The frame seal 58 will be described in detail later.

(1-2) Cartridge Holding Part

As shown in FIG. 5, the cartridge holding part 33 is a space defined by both side plates 63, a bottom plate 64, and the partition wall 23. Both side plates 63 extend continuous from both side walls 56 of the developing part 32 and the bottom plate 64 extends continuous from the bottom wall 55 of the developing part 32.

Shutter supporting portions 65 are disposed on the inner side surface in the width direction of both side plates 63. The shutter supporting portions 65 have a rectangular parallelepiped shape having an arc-like section as viewed in the width direction and protrude inward from the inner side surface in the width direction of both side plates 63.

A shutter guide portion 78 is disposed on the inner side surface in the width direction of the shutter supporting portion 65. The shutter guide portion 78 forms a convex claw protruding inward from the inner side surface of the shutter supporting portion 65 and is opposed to the curved portion 57 of the partition wall 23 with a slight gap in the front-rear direction. The shutter guide portion 78 has a curved shape having substantially the same curvature as the curved portion 57.

Upper fixing portions 66 are disposed in the inner side surface in the width direction of both side plates 63. The upper fixing portions 66 have substantially a U shape depressed obliquely to the rear downside as viewed in the width direction and protrude inward from the inner side surface in the width direction of both side plates 63. A lower fixing portion 67 protruding slightly forward is formed at the center in the width direction of the front end of the bottom plate 64 (see FIG. 3A).

A shutter 68 opening and closing the frame-side passage holes 34 is disposed in the cartridge holding part 33.

The shutter 68 has a substantially rectangular plate shape extending in the width direction and has a curved shape having substantially the same curvature as the curved portion 57 of the partition wall 23. The shutter 68 extends between the shutter guide portions 78 in the width direction and extends longer than the shutter guide portions 78 in the vertical direction. Three shutter openings 69 are formed in the shutter 68 to oppositely correspond to the frame-side passage holes 34 with a gap in the width direction.

As shown in FIGS. 3A and 3B, the shutter 68 is opposed to the curved portion 57 having the frame seal 58 bonded thereto from the front side. Both end portions thereof in the width direction are slidably interposed between the curved portion 57 and the shutter guide portions 78.

Accordingly, the shutter 68 is supported to freely swing in the vertical direction between an opening position (see FIGS. 2A and 2B) where the frame-side passage holes 34 are opened and a closing position (see FIGS. 3A, 3B and 5) where the frame-side passage holes 34 are closed along the shutter guide portions 78. Here, for the purpose of convenient explanation, the opening position of the shutter 68 is referred to as a second opening position and the closing position thereof is referred to as a second closing position.

When the shutter 68 located at the second opening position is made to move upward by a predetermined distance, the position of the shutter 68 is the second closing position. Here, for the purpose of convenient explanation, the upward movement direction of the shutter 68 from the second opening position to the second closing position is referred to as a second movement direction. Specifically, the upside in the vertical direction is downstream in the second movement direction, and the downside is downstream in the second movement direction.

As shown in FIGS. 2A and 2B, when the shutter 68 is located at the second opening position, the frame-side passage holes 34 and the cutout portions 59 oppositely communicate with the corresponding shutter openings 69 and are opened to the outside (front side). At this time, as shown in FIG. 2B, the inside edge 61 defining the cutout portion 59 in the frame seal 58 is exposed to the front side from the corresponding shutter opening 69. Particularly, in the inside edge 61, the inside edge (a more upstream portion of the frame seal 58 than the frame-side passage hole 34 in the second movement direction, which is referred to as a lower edge 61A) below the cutout portion 59 protrudes forward so that the front side surface thereof is flush with the front side surface of the shutter 68. In contrast, a portion of the inside edge 61 (a more downstream portion of the frame seal 58 than the frame-side passage hole 34 in the second movement direction, which is referred to as an upper edge 61B) above the cutout portion 59 are slightly exposed from the shutter opening 69 and most thereof is pressed on the shutter 68 (a portion of the shutter 68 above the shutter opening 69). A portion (portion more apart from the cutout portion 59 than the inside edge 61) of the frame seal 58 other than the inside edge 61 is compressed between the curved portion 57 of the partition wall 23 and the shutter 68 so as to surround a gap between the frame-side passage hole 34 and the shutter opening 69. Accordingly, the developer is prevented from leaking from the frame-side passage hole 34 and the shutter opening 69 communicating with each other to the gap between the curved portion 57 and the shutter 68.

When the shutter 68 is located at the second closing position, as shown in FIGS. 3A and 3B, the frame-side passage holes 34 and the cutout portions 59 are closed from the front side by the portion of the shutter 68 below the shutter openings 69.

Here, as shown in FIG. 5, the front side surface of the shutter 68 is provided with a sheet 40. The sheet 40 is a rectangular sheet longitudinal in the width direction and being formed of a flexible member (such as a PET film, a rubber, or a thin metal plate). The size of the sheet 40 in the width direction is greater than a distance between the left end of the left shutter opening 69 and the right end of the right shutter opening 69.

The sheet 40 is disposed continuous from the lower ends of all the shutter openings 69 of the shutter 68 and a part (referred to as a block portion 41) of the upper end of the sheet 40 protrudes upward in the shutter openings 69. Specifically, the block portions 41 of the sheet 40 are located at the same positions in the width direction as the corresponding shutter openings 69 and cover the lower end portions 60 of the corresponding shutter openings 69 from the front side (from the cartridge holding part 33 side) as shown in FIG. 2B. Here, the lower end portions 60 are upstream end portions of the shutter openings 69 in the second movement direction. Rear side surfaces (referred to as bonding surfaces 42) of portions of the sheet 40 below the block portions 41 are bonded to the front side surfaces of portions of the shutter 68 below the shutter openings 69.

The bonding surfaces 42 of the sheet 40 are bonded to the front side surface of the shutter 68 so that the block portions 41 protrude from the downside in the shutter openings 69. Here, the protruding distance of the block portions 41 into the shutter openings 69 is set to, for example, 0.5 mm (at most 1.0 mm). Accordingly, the block portions 41 protrudes more upward than the portions (referred to as lower edges 68A) defining the lower end portions 60 of the shutter openings 69 in the shutter 68. That is, when the block portions 41 and the lower edges 68A of the shutter 68 are all referred to as a protruding portion 76, the protruding portion 76 is disposed at the lower end portions 60 of the shutter openings 69 of the shutter 68. In the protruding portion 76, the front ends (block portions 41) protrude more upward (downstream in the second movement direction) than the rear ends (lower edges 68A). As shown in FIGS. 3A and 3B, an angle between the protruding direction of the block portions 41 and the horizontal surface when the shutter 68 is located at the second closing position is, for example, 40° upward.

As shown in FIG. 5, the cartridge holding part 33 is provided with a swing arm 70. The swing arm 70 has substantially a U shape in a plan view. The swing arm 70 monolithically includes a grip rod 71 extending in the width direction and arm side plates 72 extending from both end portions of the grip rod 71 in the width direction to the rear side.

Bosses 73 protruding outward in the width direction are disposed in the rear end portions of the arm side plates 72. The bosses 73 are rotatably supported by round holes 74 formed in the corresponding side plates 63.

A receiving concave portion 75 cut depressed downward is formed at upper ends of the rear end portions of the arm side plates 72.

The swing arm 70 swings about the bosses 73 of the arm side plates 72 between a press releasing position (see FIGS. 3 and 5) where the lower ends of the arm side plates 72 come in contact with the front end of the bottom plate 64 and a pressing position (see FIGS. 2, 4, and 6) where the developer cartridge 31 is pressed from the front side when the developer cartridge 31 is held in the cartridge holding part 33.

(2) Developer Cartridge

Figure 7B:
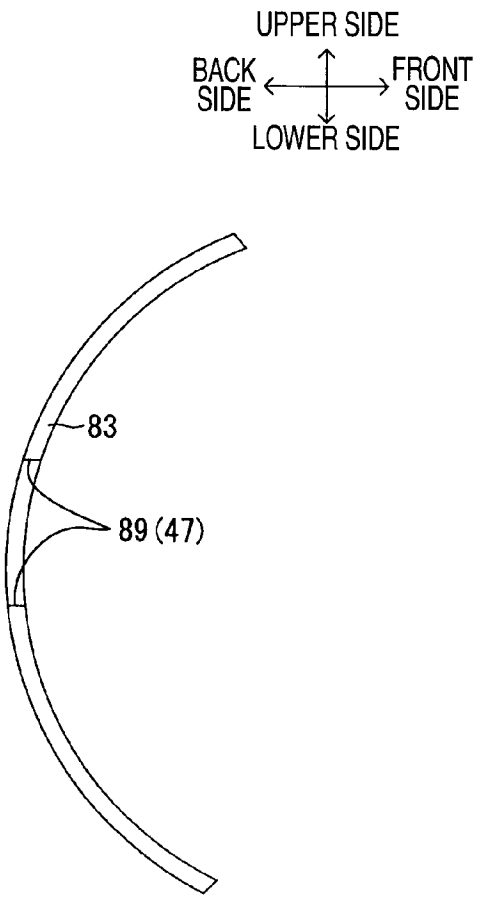
FIG. 7B is a partial sectional view of the inside housing shown in FIG. 7A around an inside passage hole.
Figure 7A:
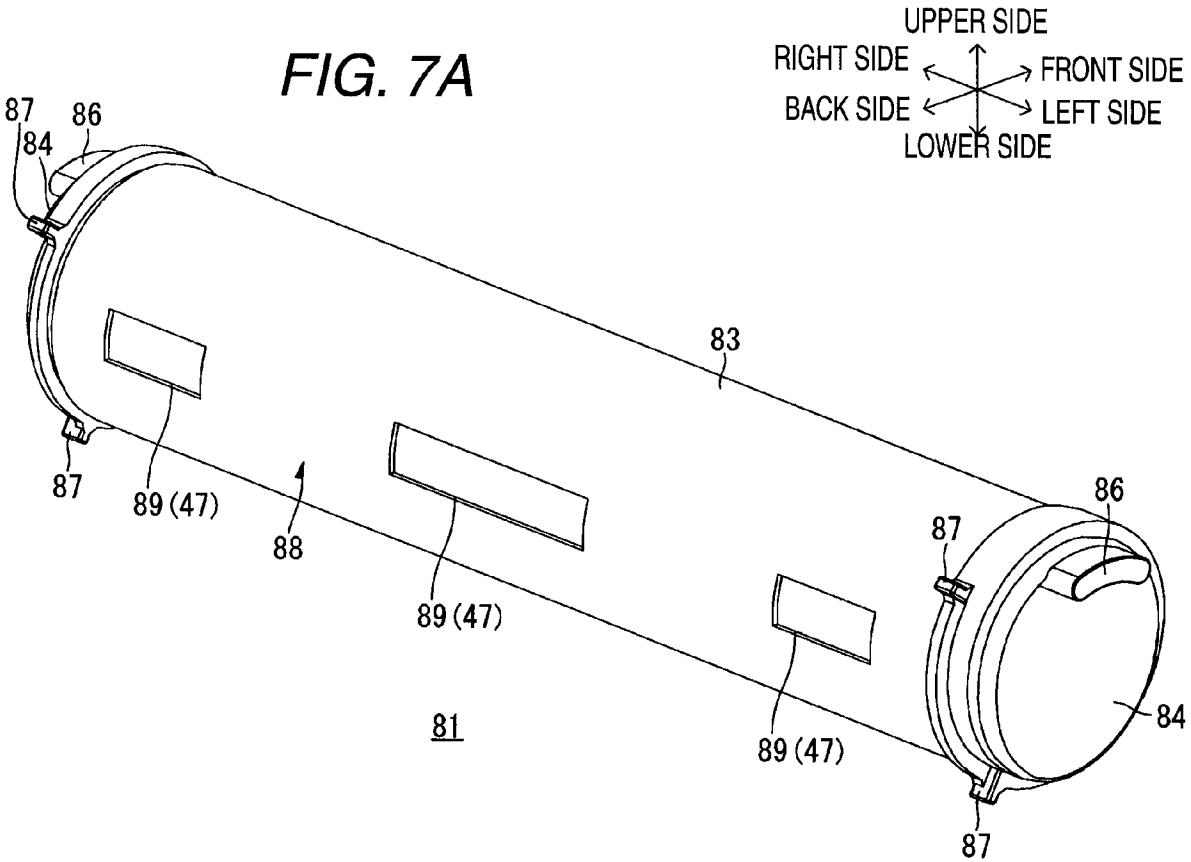
FIG. 7A is a perspective view of an inside housing of the developer cartridge as obliquely viewed from a rear left side, showing a state where a developer seal is not bonded.
Figure 8A:
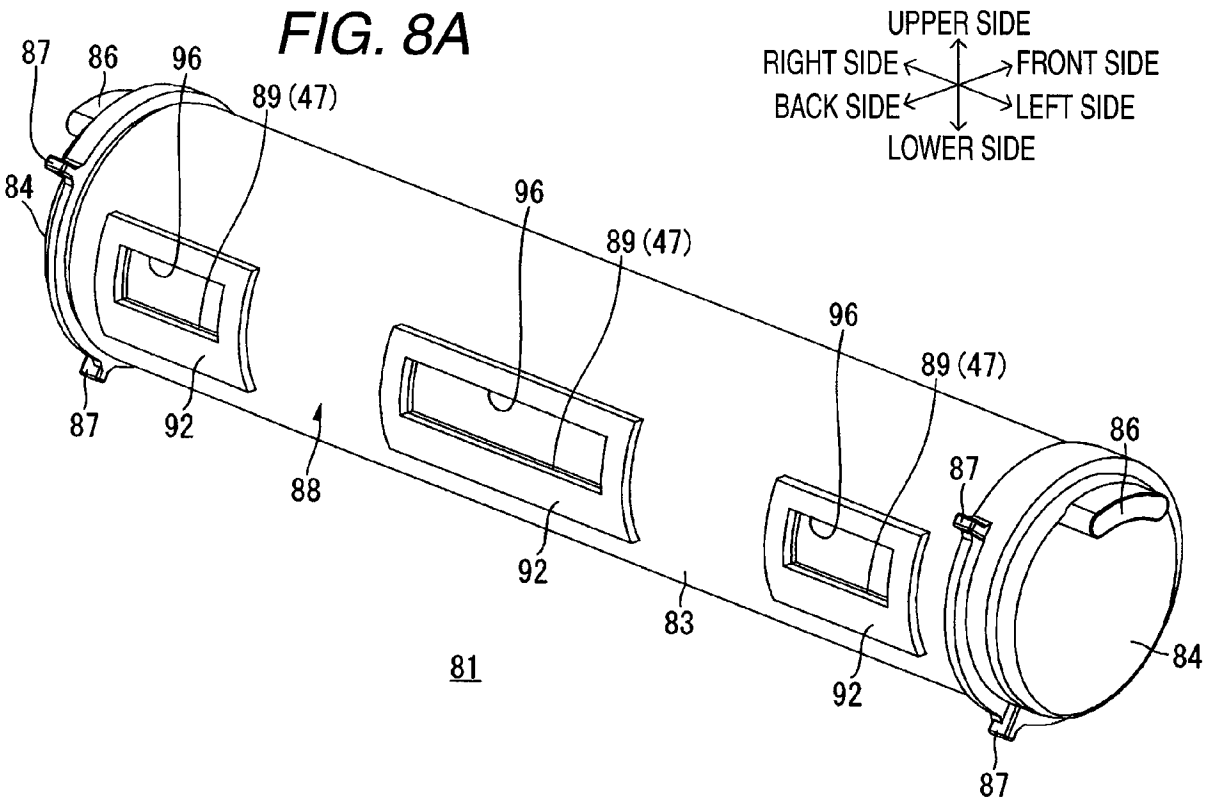
FIG. 8A is a diagram showing a state where the developer seal is bonded in FIG. 7A.
Figure 8B:
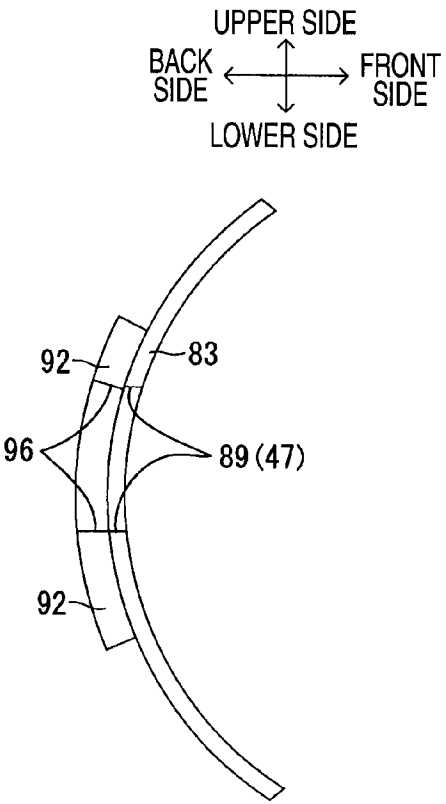
FIG. 8B is a diagram showing a state where the developer seal is bonded in FIG. 7B.
Figure 9A:
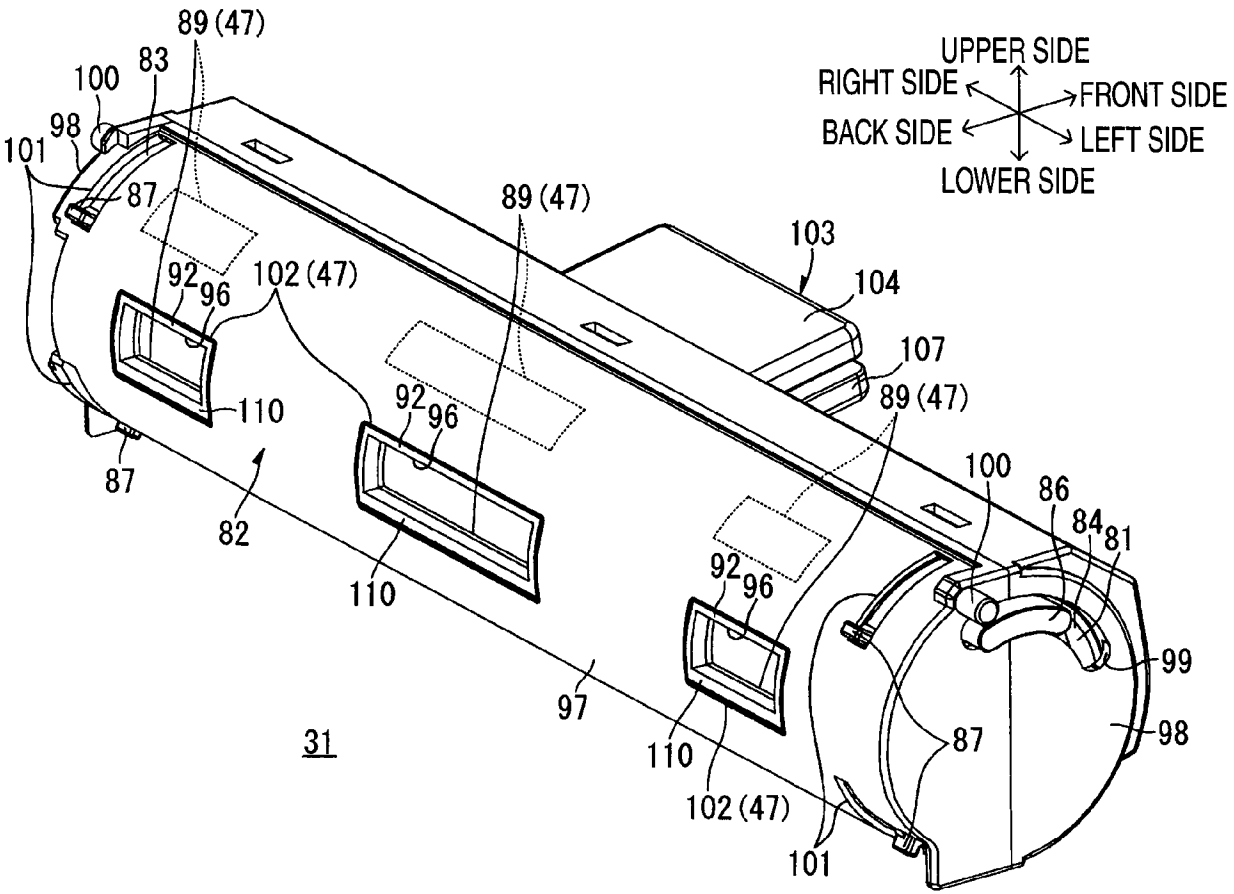
FIG. 9A is a perspective view of the developer cartridge as obliquely viewed from the rear left side, showing a state where the inside housing is located at a first opening position.
Figure 9B:
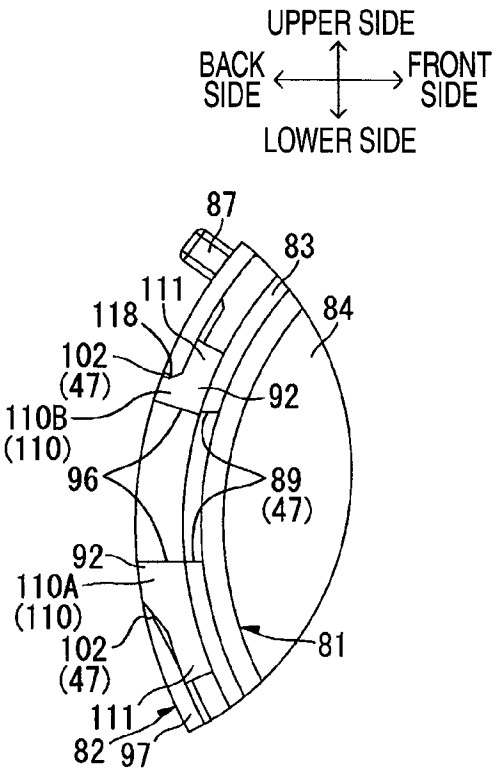
FIG. 9B is a partial sectional view of the developer cartridge shown in FIG. 9A around a cartridge-side passage hole.
Figure 10A:
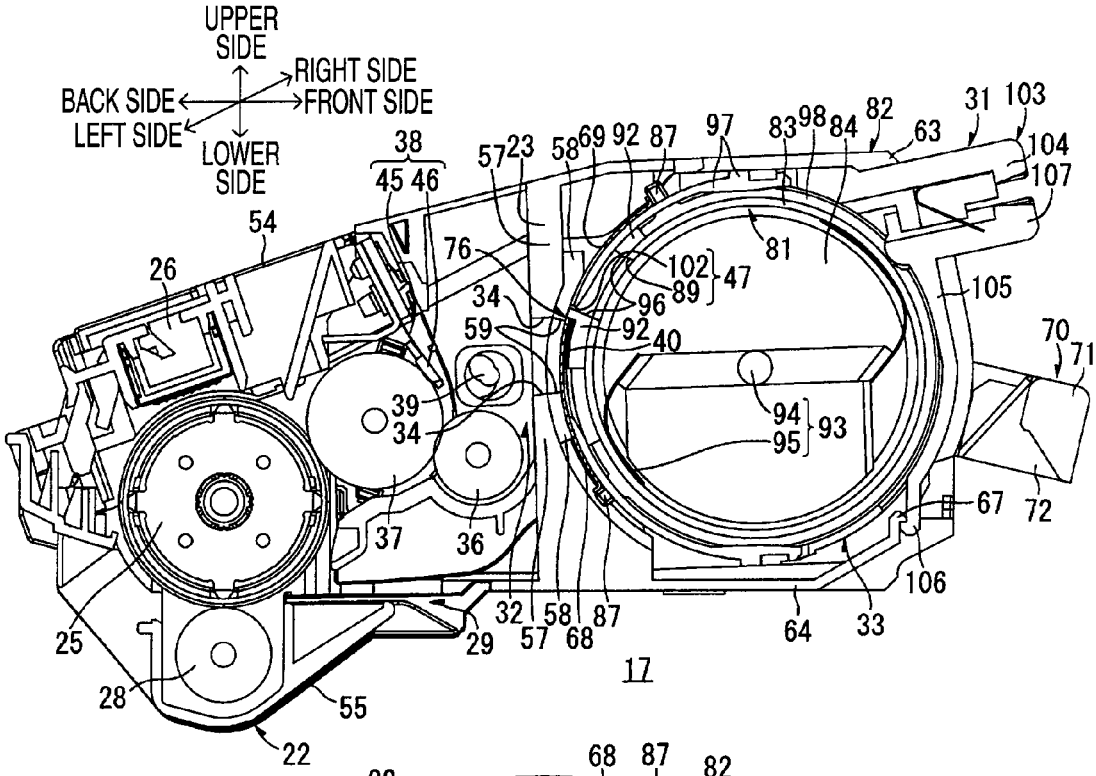
FIG. 10A is a diagram showing a state where the swing arm is located between the pressing position and the press releasing position in FIG. 2A.
Figure 10B:
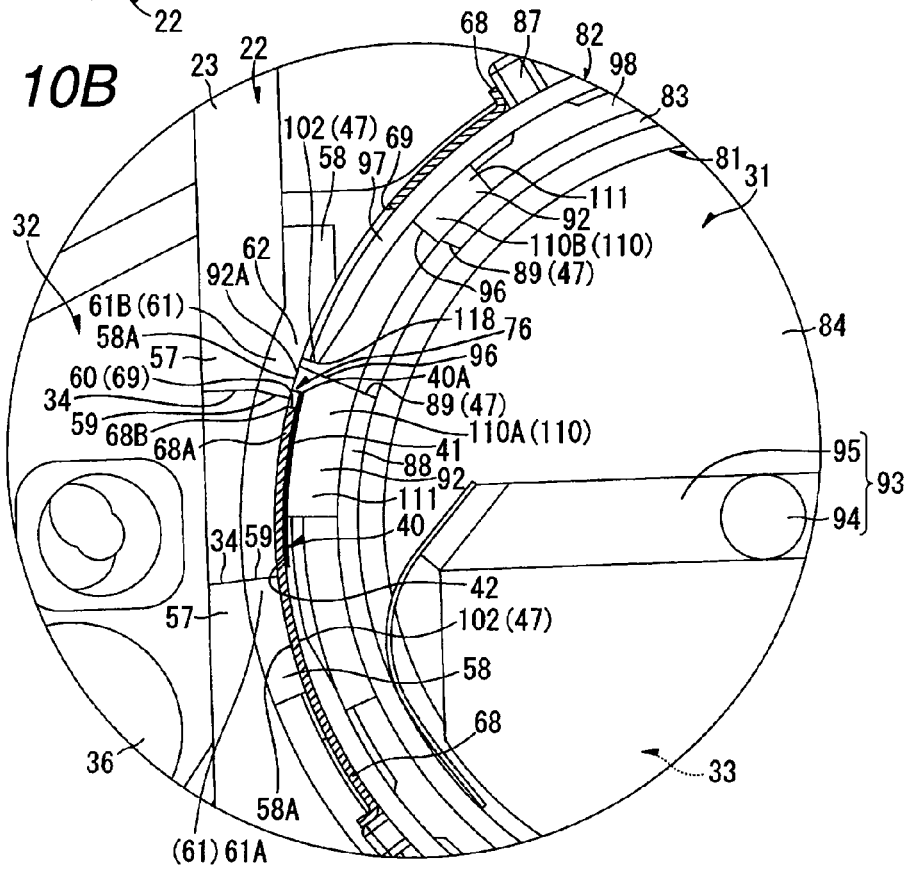
FIG. 10B is a partial enlarged view of FIG. 10A.
Figure 11A:
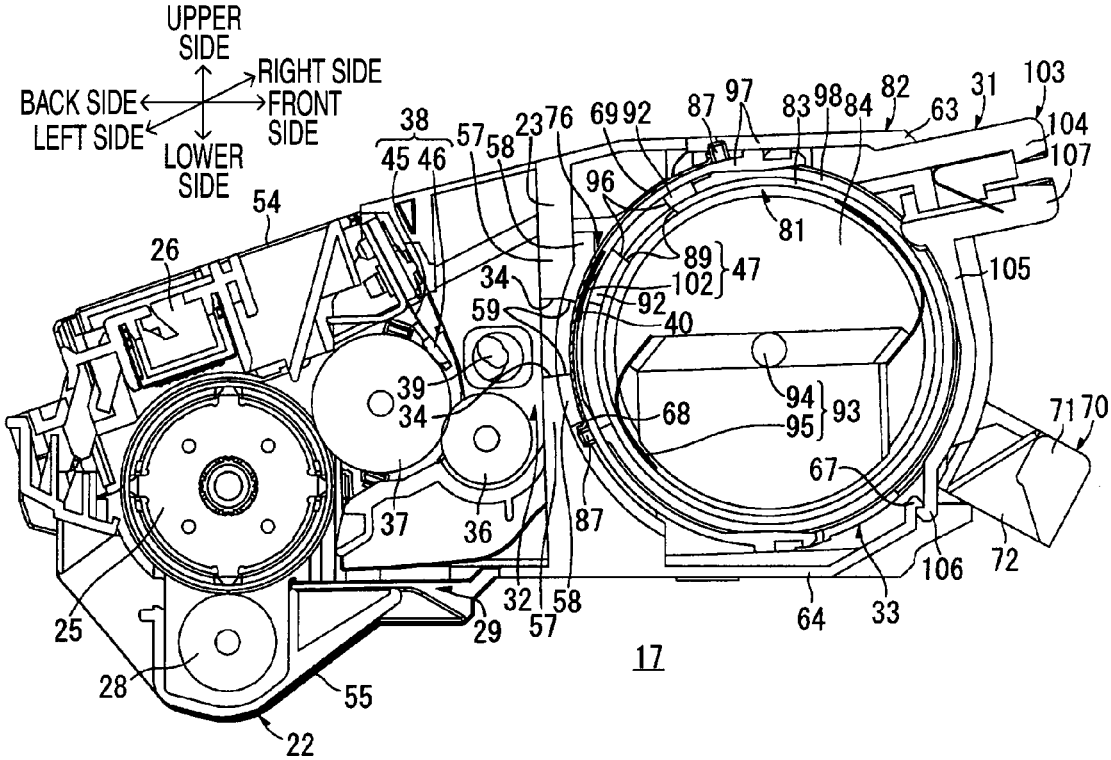
FIG. 11A is a diagram showing a state where the swing arm is located at the press releasing position in FIG. 2A.
Figure 11B:
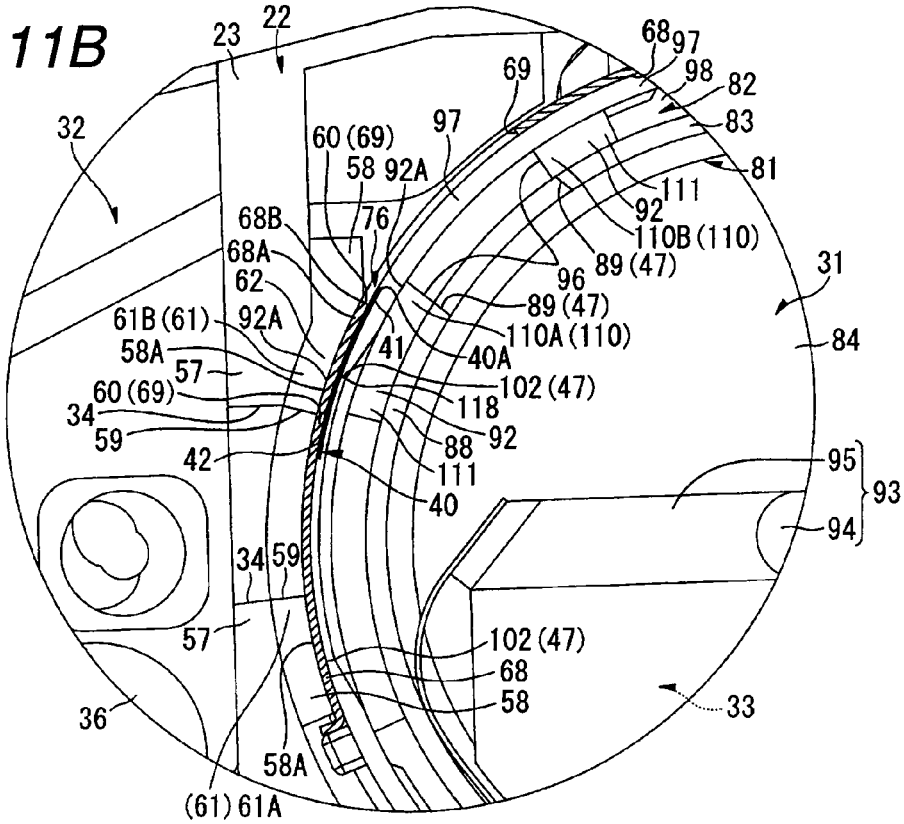
FIG. 11B is a partial enlarged view of FIG. 11A.

FIG. 7A is a perspective view showing an inside housing (before a developer seal is bonded thereto) of the developer cartridge as obliquely viewed from the back left side. FIG. 7B is a partial side sectional view of an inside passage hole of the inside housing shown in FIG. 7A. FIG. 8A shows a state where the developer seal is bonded in FIG. 7A. FIG. 8B shows a state where the developer seal is bonded in FIG. 7B. FIG. 9A is a perspective view of the developer cartridge (a state where the inside housing is located at a first opening position) as viewed obliquely from the rear left side and FIG. 9B is a partial sectional view of the developer cartridge shown in FIG. 9A around a cartridge-side passage hole. FIG. 10A is a diagram showing a state where the swing arm is located between the pressing position and the press releasing position in FIG. 2A and FIG. 10B is a partial enlarged view of FIG. 10A. FIG. 11A is a diagram showing a state where the swing arm is located at the press releasing position in FIG. 2A and FIG. 11B is a partial enlarged view of FIG. 11A.

As shown in FIGS. 7 to 11, the developer cartridge 31 includes an inside housing 81 as an example of the inside frame accommodating the developer and an outside housing 82 as an example of the outside frame housing the inside housing 81.

(2-1) Inside Housing

As shown in FIG. 7A, the inside housing 81 monolithically includes a cylindrical inside circumferential wall 83 extending in the width direction and a pair of cylindrical inside walls 84 closing both end portions in the width direction of the inside circumferential wall 83. In the following description, the state where the inside passage hole 89 as an example of the first opening to be described later faces the rear side is used as a reference.

A slide protrusion 86 is disposed at one position (upper end portion in FIG. 7A) on the circumferential edge of the inside wall 84. The slide protrusion 86 has a circular arc shape along the outer circumferential surface of the inside wall 84 in a side view and protrudes outward in the width direction from the inside wall 84.

A pair of interposing protrusions 87 protruding in the diameter direction from the circumferential end surface is disposed in the backside portion of the inside wall 84. The pair of interposing protrusions 87 is disposed in the circumferential end surface of the inside wall 84 with a gap in the circumferential direction (a gap corresponding to the circumferential length of the shutter 68).

In the inside circumferential wall 83, the inside passage holes 89 forming a part of the cartridge-side passage holes 47 are formed in a surrounding portion 88 surrounded with the pair of interposing protrusions 87 (four interposing protrusions 87) disposed at both ends in the width direction.

The inside passage holes 89 have substantially a rectangular shape longitudinal in the width direction as viewed in a rear surface. Specifically, three inside passage holes are formed with a gap in the width direction to correspond to three frame-side passage holes 34 (see FIG. 6). At the time of forming an image, the inside passage holes 89 are opposed to the frame-side passage holes 34 (see FIG. 6) and the shutter openings 69 of the shutter 68 (see FIG. 6) located at the corresponding positions in the width direction.

As shown in FIG. 8A, three developer seals 92 for preventing the developer from leaking from the inside passage holes 89 are boned to the surrounding portion 88 to correspond to the inside passage holes 89. The developer seals 92 serve as an example of the first seal. The developer seals 92 are formed in a band shape being longitudinal in the width direction as viewed from the rear side and having an almost uniform length (thickness) in the front-rear direction out of an elastic foamed material (product name: Poron SR-S-24P, made by ROGERS INOAC Corporation). The developer seals 92 will be described in detail later.

In the developer seals 92, cutout portions 96 penetrating the developer seals 92 in the front-rear direction are formed at positions slightly deviated upward from the center position as viewed from the rear side so as to correspond to the inside passage holes 89. The cutout portions 96 has a substantially rectangular shape having substantially the same size as the corresponding inside passage holes 89 as viewed from the rear side, and are opposed to the corresponding inside passage holes 89. In this way, the developer seals 92 are disposed around the inside passage holes 89 and protrudes outward in the diameter direction so that the cutout portions 96 surround the corresponding inside passage holes 89.

As shown in FIG. 2A, the inside housing 81 is provided with the agitator 93. The agitator 93 includes an agitator shaft 94 extending in the width direction and agitation blades 95 extending outward in the diameter direction from the agitator shaft 94. The agitator shaft 94 is rotatably supported by both side walls 84 and rotates with a driving force from a motor (not shown) at the time of forming an image.

(2-2) Outside Housing

The outside housing 82 is slightly greater in the width direction and the diameter direction than the inside housing 81 so as to rotatably house the inside housing 81. As shown in FIG. 9A, the outside housing 82 monolithically includes a substantially cylindrical outside circumferential wall 97 extending in the width direction and a pair of outside walls 98 closing both end portions in the width direction of the outside circumferential wall 97 and having substantially a disk shape.

In the following description, as long as not particularly mentioned, a state where the outside passage holes 102 face the rear side is used as a reference.

The outer circumferential surfaces of the upper portion and the front upper portion of the outside circumferential wall 97 have a flat shape, but the inner circumferential surface of the outer circumferential surface 97 has a circular section (see FIGS. 2A and 2B).

Slide holes 99 into which the slide protrusions 86 are inserted are formed in the upper portions of the outside walls 98. The slide holes 99 are disposed to face the slide protrusions 86 in the width direction. The slide holes 99 have a circular arc shape longer than the slide protrusions 86 in the side view. The upper end portions of the outside walls 98 are provided with a boss 100 protruding outward in the width direction. Four longitudinal holes 101 into which a pair of interposing protrusions 87 (four interposing protrusions 87) are inserted are formed in both end portions in the width direction of the outside circumferential wall 97. The longitudinal holes 101 are disposed to face the interposing protrusions 87 in the diameter direction. The longitudinal holes 101 has a substantially rectangular shape vertically extending in the rear view and have a length corresponding to a swing range between the second opening position and the second closing position of the shutter 68.

In the outside circumferential wall 97, outside passage holes 102 forming a part of the cartridge-side passage holes 47 are formed between four longitudinal holes 101 (between two upper longitudinal holes 101 and two lower longitudinal holes 101).

Three outside passage holes 102 are formed with a gap in the width direction to correspond to three inside passage holes 89 and the frame-side passage holes 34 (see FIG. 6). The outside passage holes 102 have substantially a rectangular shape greater than the corresponding inside passage holes 89 as viewed from the rear side. At the time of forming an image, the outside passage holes 102 are opposed to the inside passage holes 89, the cutout portions 96 of the developer seals 92, the frame-side passage holes 34 (see FIG. 6), the cutout portions 59 (see FIG. 6) of the frame seals 58, and the shutter openings 69 (see FIG. 6) of the shutter 68, which are located at the corresponding positions in the width direction.

A grasp portion 103 is disposed in front of the outside circumferential wall 97. As shown in FIG. 2A, the grasp portion 103 includes an upper grasp plate 104 protruding forward from the upper end portion of the outside circumferential wall 97 and a locking arm 105 having substantially a J shape extending downward in the side view below the upper grasp plate 104. The upper end portion of the locking arm 105 is pivotably supported by a supporting pivot (not shown) disposed below the upper grasp plate 104. A locking claw 106 locked to a lower locking portion 67 is disposed in the lower end portion of the locking arm 105. A lower grasp plate 107 protruding forward is monolithically disposed in the vicinity of the upper end portion of the locking arm 105. The lower grasp plate 107 is disposed parallel to the upper grasp plate 104 with a gap therebetween and a compression spring (not shown) urging the plates in the direction in which they get apart from each other is interposed between the upper grasp plate 104 and the lower grasp plate 107.

(2-3) Relative Arrangement of Inside Housing and Outside Housing

The inside housing 81 is rotatably housed in the outside housing 82.

Specifically, the outer circumferential surface of the inside circumferential wall 83 is disposed to be slidable relative to the inner circumferential surface of the outside circumferential wall 97 in the circumferential direction. More specifically, the developer seals 92 disposed in the outer circumferential surface of the inside circumferential wall 83 come in contact with the inner circumferential surface of the outside circumferential wall 97, and the developer seals 92 slides relative to the inner circumferential surface of the outside circumferential wall 97. As shown in FIG. 9A, the slide protrusions 86 are inserted into the slide holes 99. The interposing protrusions 87 are inserted into the longitudinal holes 101 and the interposing protrusions 87 protrude outward in the diameter direction from the longitudinal holes 101.

The inside housing 81 is allowed to rotate relative to the outside housing 82 between the closing position (see FIGS. 5 and 11) where the inside passage holes 89 and the cutout portions 96 of the developer seals 92 are not opposed to the outside passage holes 102 and the opening position (see FIGS. 2 and 9) where the inside passage holes 89 and the cutout portions 96 are opposed to the outside passage holes 102. Here, for the purpose of convenient explanation, the opening position of the inside housing 81 is referred to as a first opening position and the closing position thereof is referred to as a first closing position.

When the inside housing 81 is located at the first closing position, as shown in FIG. 5, the slide protrusions 86 are disposed in the front end portions of the slide holes 99, respectively, and the interposing protrusions 87 are disposed in the upper end portions of the longitudinal holes 101, respectively. As indicated by the dotted lines in FIG. 9A and as shown in FIGS. 11A and 11B, the inside passage holes 89 are disposed above the outside passage holes 102, and the outside passage holes 102 are closed from the inside in the diameter direction by a portion of the inside circumferential wall 83 below the inside passage holes 89 (portion indicated by the dotted line in FIG. 9A). On the contrary, the inside passage holes 89 are closed from the outside by a portion of the outside circumferential wall 97 above the outside passage holes 102.

Here, the developer seals 92 are compressed between the inside circumferential wall 83 and the outside circumferential wall 97 as shown in FIGS. 11A and 11B.

In a state where the inside passage holes 89 face the outside passage holes 102 (downside), the inside housing 81 is made to rotate relative to the outside housing 82, and the inside housing 81 is located at the first opening position when the inside passage holes 89 and the cutout portions 96 are opposed to the outside passage holes 102.

When the inside housing 81 is located at the first opening position, as shown in FIG. 9A, the slide protrusions 86 are located in the rear end portions of the slide holes 99 and the interposing protrusions 87 are located in the lower end portions of the longitudinal holes 101. The inside passage holes 89 and the cutout portions 96 are opposed to the corresponding outside passage holes 102 and they communicate with each other.

In the state where the inside housing 81 is located at the first opening position, the inside edges 110 defining the cutout portions 96 in the developer seals 92 are exposed from the corresponding outside passage holes 102. Specifically, as shown in FIG. 9B, the inside edges 110 protrude outward in the diameter direction so that the outside surface in the diameter direction is flush with the outside surface of the outside circumferential surface 97. The portions (being more apart from the cutout portions 96 than the inside edges 110 and being referred to as outside edges 111) of the developer seals 92 other than the inside edges 110 are compressed between the outside circumferential wall 97 and the inside circumferential wall 83 so as to surround the corresponding inside passage holes 89. Accordingly, the developer is prevented from leaking from the inside passage holes 89 and the outside passage holes 102 communicating with each other to the gap between the outside circumferential wall 97 and the inside circumferential wall 83.

The inside housing 81 moves upward from the first opening position to the first closing position and this movement direction is referred to as a first movement direction for the purpose of convenient explanation. The first movement direction is almost equal to the second movement direction (upward) of the shutter 68.

(3) Attachment and Detachment of Developer Cartridge to and from Process Frame (3-1) Attachment of Developer Cartridge to Process Frame When it is intended to attach the developer cartridge 31 to the process frame 22, as shown in FIG. 5, the upper grasp plate 104 and the lower grasp plate 107 are pressed against the urging force of the compression spring (not shown) in a direction in which both plates get close to each other. Then, the developer cartridge 31 (the developer cartridge 31 in which the inside housing 81 is located at the first closing position) is attached to the cartridge holding part 33 (the cartridge holding part 33 in which the shutter 68 is located at the second closing position and the swing arm 70 is located at the press releasing position).

Accordingly, the developer cartridge 31 is placed on the bottom plate 64. At this time, the bosses 100 are received in the upper locking portions 66 and the slide protrusions 86 are inserted into the receiving concave portions 75, as shown in FIG. 2A, whereby the pair of interposing protrusions 87 on both sides in the width direction interpose the upper end and the lower edges and the upper edges of both ends in the width direction of the shutter 68. Accordingly, the inside housing 81 having the slide protrusions 86 and the interposing protrusions 87 engages with the swing arm 70 and the shutter 68.

Thereafter, when the interposition of the upper grasp plate 104 and the lower grasp plate 107 is released, the locking arm 105 swings with the urging force of the compression spring and the locking claws 106 are locked to the lower locking portions 67, whereby the developer cartridge 31 is housed in the cartridge holding part 33 and is held by the cartridge holding part 33.

The outside housing 82 is fixed to the cartridge holding part 33, since the bosses 100 are received in the upper locking portions 66 and the locking claws 106 are locked to the lower locking portions 67. At this time, as shown in FIGS. 11A and 11B, the frame-side passage holes 34 and the corresponding cartridge-side passage holes 47 (specifically, the outside passage holes 102) are opposed to each other in the front-rear direction with the shutter 68 located at the second closing position therebetween. That is, the front side of the shutter 68 is close to the cartridge-side passage holes 47 (cartridge holding part 33) and the rear side thereof is close to the frame-side passage holes 34 (more apart from the cartridge holding part 33 than the front side). The shutter 68 is located closer to the cartridge-side passage holes 47 (inside passage holes 89) from the frame-side passage holes 34 than the frame seals 58. The shutter openings 69 of the shutter 68 located at the second closing position are separated from a position between the frame-side passage holes 34 and the cartridge-side holes 47 (the inside passage holes 89 and the outside passage holes 102).

Then, the swing arm 70 is made to swing from the press releasing position to the pressing position. Accordingly, the slide protrusions 86 inserted into the receiving concave portions 75 (see FIG. 5) slide backward in the slide holes 99 with the swing of the arm side plates 72 and are located in the rear end portions of the slide holes 99 (see FIG. 9A). Accordingly, the pair of interposing protrusions 87 on both sides in the width direction slide downward in the longitudinal holes 101 with the shutter 68 interposed therebetween and are located in the lower end portions of the longitudinal holes 101 (see FIG. 9A).

Accordingly, the inside housing 81 is located at the first opening position and as shown in FIGS. 2A and 9, the inside passage holes 89 and the cutout portions 96 of the developer seals 92 are opposed to the corresponding outside passage holes 102 in the horizontal direction, whereby they communicate with each other. The shutter 68 engaging with the inside housing 81 moves along with the inside housing 81 and is located at the second opening position. The frame-side passage holes 34 and the cutout portions 59 of the frame seals 58 are opposed substantially in the horizontal direction to the corresponding shutter openings 69 and the corresponding cartridge-side passage holes 47 (including the inside passage holes 89, the cutout portions 96, and the outside passage holes 102 communicating with each other), whereby they communicate with each other. Here, the shutter openings 69 of the shutter 68 located at the second opening positions are disposed between the frame-side passage holes 34 and the cartridge-side passage holes 47.

As shown in FIG. 2B, when the inside housing 81 and the shutter 68 are located at the opening position together, the inside edges 110 of the developer seals 92 protruding outside in the diameter direction of the outside circumferential wall 97 protrudes backward to surround the corresponding shutter openings 69. Specifically, the inside edges (portions of the developer seals 92 being located more upstream than the inside passage holes 89 in the first movement direction and referred to as lower edges 110A) below the cutout portions 96 in the inside edges 110 is pressed on the lower edges 61A below the cutout portions 59 in the frame seals 58. The inside edges (portions of the developer seals 92 being located more downstream than the inside passage holes 89 in the first movement direction and referred to as upper edges 110B) above the cutout portions 96 in the inside edges 110 of the developer seals 92 are pressed on the shutter 68 (portions of the shutter 68 above the shutter openings 69). Here, the portions of the shutter 68 above the shutter openings 69 are disposed between the portions (upper edges 61B) of the frame seals 58 above the cutout portions 59 and the portions (upper edges 110B) of the developer seals 92 above the cutout portions 96. The surfaces (front side surface) of the frame seals 58 coming contact with the developer seals 92 are referred to as frame-seal contact surfaces 58A as an example of a second contact portion and the surfaces of the lower edges 110A of the developer seals 92 coming in contact with the frame seals 58 (the lower edges 61A) are referred to as developer-seal contact surfaces 92A as an example of a first contact portion. That is, the frame-seal contact surfaces 58A are contact portions of the frame seals 58 with the developer seals 92 and the developer-seal contact surfaces 92A are contact portions of the developer seals 92 with the frame seals 58. In the state where the lower edges 110A are pressed on the lower edges 61A, the developer-seal contact surfaces 92A are in contact with the frame-seal contact surfaces 58A in the lower edges 61A.

In this way, since the spaces between the inside passage holes 89 and the frame-side passage holes 34 are covered with the frame seals 58, the developer seals 92, and the shutter 68 without any gap, the developer is prevented from leaking between the inside passage holes 89 and the frame-side passage holes 34.

Between the lower circumferential edges of the inside passage holes 89 and the lower circumferential edges of the frame-side passage holes 34, a flat surface 77 along the horizontal direction is formed continuous by the lower edges 61A of the frame seals 58 and the lower edges 110A of the developer seals 92. Here, the protruding portions 76 (the lower edges 68A of the shutter 68 and the block portions 41 of the sheet 40) are disposed below the flat surface 77 (the lower ends of the inside passage holes 89 and the lower ends of the frame-side passage holes 34).

That is, the upper ends 40A (also upper ends of the block portions 41) of the sheet 40 and the upper ends 68B (lower ends of the shutter openings 69 of the shutter 68) of the lower edges 68A of the shutter 68 are not exposed from the cutout portions 59 of the frame seals 58 and the cutout portions 96 of the developer seals 92 and are disposed below the lower ends of the cutout portions.

At the time of forming an image, the developer in the inside housing 81 is supplied to the developing part 32 with the agitation of the agitator 93 through the inside passage holes 89, the cutout portions 96 of the developer seals 92, the outside passage holes 102, the shutter openings 69, the cutout portions 59 of the frame seals 58, and the frame-side passage holes 34 in the horizontal direction, as indicated by a solid arrow in the drawings). At this time, the developer moves over the flat surface 77. The developer may be made to circulate between the developing part 32 and the developer cartridge 31. In this case, the developer in the developer cartridge 31 is supplied into the developing part through the cartridge-side passage hole 47 (see FIG. 9A) and the frame-side passage hole 34 (see FIG. 6) located at the center in the width direction, and is supplied to the supply roller 36 while being conveyed to both sides in the width direction by the auger 39. In contrast, some developer is returned to the developer cartridge 31 through the frame-side passage holes 34 and the cartridge-side passage holes 47 located at both sides in the width direction. Here, since the developer returned to the developer cartridge 31 includes the developer charged into the positive polarity, the developer in the developer cartridge 31 other than the developer returned into the developer cartridge 31 is charged into the positive polarity to some extent.

(3-2) Detachment of Developer Cartridge from Process Frame

When it is intended to detach the developer cartridge 31 from the process frame 22, first, the swing arm 70 is made to swing from the pressing position to the press releasing position (see FIG. 3A).

When the swing arm 70 is made to swing from the pressing position to the press releasing position, as shown in FIG. 5, the slide protrusions 86 inserted into the receiving concave portions 75 start sliding forward in the slide holes 99 with the swing of the arm side plates 72. Accordingly, the inside housing 81 starts moving from the first opening position to the first closing position (in the first movement direction) and the pair of interposing protrusions 87 on both sides in the width direction shown in FIG. 2A start sliding upward in the longitudinal holes 101 with the shutter 68 interposed therebetween. At this time, the developer-seal contact surfaces 92A in contact with the frame-seal contact surfaces 58A in the lower edges 61A when the inside housing 81 is located at the first opening position come in sliding contact with the frame-seal contact surfaces 58A with the movement of the inside housing 81. Here, based on the frame-seal contact surfaces 58A, the frame-seal contact surfaces 58A come in sliding contact with the developer-seal contact surfaces 92A. The developer-seal contact surfaces 92A ends the sliding contact with the frame-seal contact surfaces 58A in the lower edges 61A, cross the cutout portions 59 (where they are exposed from the frame-side passage holes 34), and come in sliding contact with the frame-seal contact surfaces 58A in the upper edges 61B as shown in FIG. 10B.

When the inside housing 81 further moves to the first closing position, the lower edges 110A of the developer seals 92 come in contact with the portions (referred to as contact portions 118) of the outside circumferential wall 97 forming the upper circumferential edges of the outside passage holes 102, are compressed to the inside circumferential walls 83, and enters between the outside circumferential wall 97 and the inside circumferential wall 83 (see FIG. 11B). At this time, the developer-seal contact surfaces 92A come in sliding contact with the contact portions 118.

When the inside housing 81 moves to the first closing position, as shown in FIG. 5, the slide protrusions 86 are located in the front end portions of the slide holes 99 and the pair of interposing protrusions 87 on both sides in the width direction slide upward in the longitudinal holes 101 with the shutter 68 interposed therebetween and are located in the upper end portions of the longitudinal holes 101.

Accordingly, in the developer cartridge 31, as shown in FIGS. 11A and 11B, the inside housing 81 is located at the first closing position and the outside passage holes 102 and the inside passage holes 89 are closed together as described above. The shutter 68 engaging with the inside housing 81 moves monolithically with the inside housing 81 is located at the second closing position, and the frame-side passage holes 34 and the cutout portions 59 of the frame seals 58 are opposed to the shutter 68 and closed thereby (see FIGS. 3A and 3B).

When the upper grasp plate 104 and the lower grasp plate 107 are grasped in the direction in which they get close to each other, the locking of the locking claws 106 to the lower fixing portion 67 is unlocked. Accordingly, as shown in FIG. 5, when the developer cartridge 31 is drawn forward out of the cartridge holding part 33, the slide protrusions 86 are separated from the receiving concave portions 75 and the interposing protrusions 87 are separated from the shutter 68. Accordingly, the engagement of the inside housing 81 with the swing arm 70 and the shutter 68 is released and the developer cartridge 31 is detached from the process frame 22.

(4) Frame Seal and Developer Seal

Figure 12A:
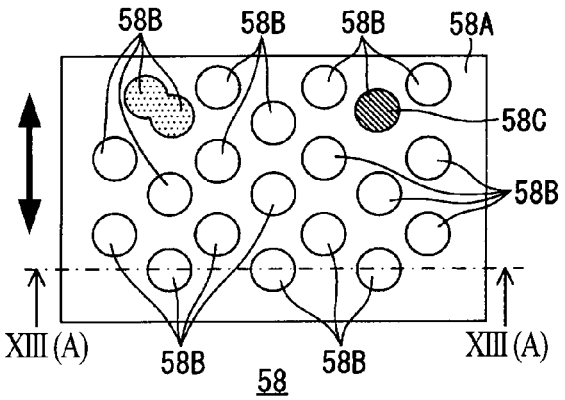
FIG. 12A is a diagram showing a part of a frame seal as viewed from a side opposed to a frame-seal contact surface.
Figure 12B:
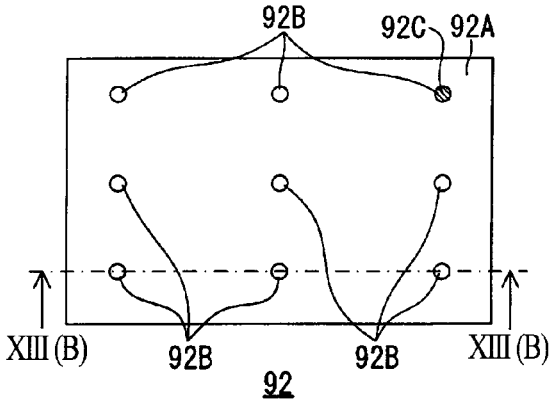
FIG. 12B is a diagram showing a part of the developer seal as viewed from a side opposed to a developer-seal contact surface.
Figure 13A:
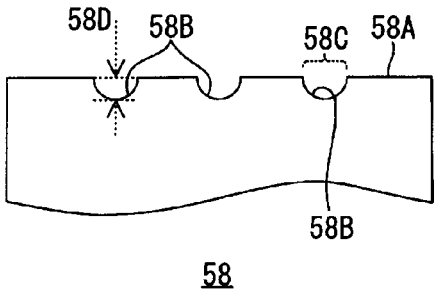
FIG. 13A is a sectional view taken along line XIII(A)-XIII(A) of FIG. 12A.
Figure 13B:
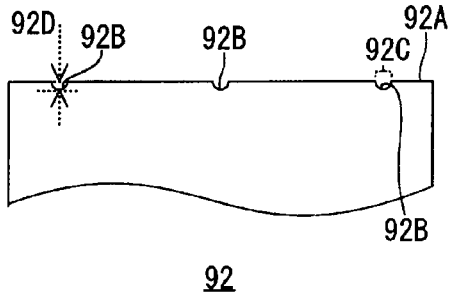
FIG. 13B is a sectional view taken along line XIII(B)-XIII(B) of FIG. 12B.
Figure 14:
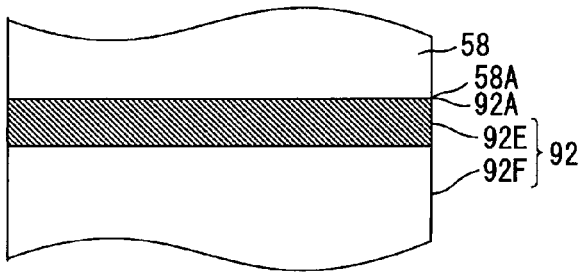
FIG. 14 is a diagram showing a state where the developer seal is in contact with the frame seal.

FIG. 12A is a diagram showing a part of the frame seal as viewed from the side opposed to the frame-seal contact surface, and FIG. 12B is a diagram showing a part of the developer seal as viewed from a side opposed to the developer-seal contact surface. FIG. 13A is a sectional view taken along line XIII(A)-XIII(A) of FIG. 12A, and FIG. 13B is a sectional view taken along line XIII(B)-XIII(B) of FIG. 12B. FIG. 14 is a diagram showing a state where the developer seal is in contact with the frame seal.

As described above, since the frame seals 58 and the developer seals 92 are formed of a foamed material, depressed portions are formed the frame-seal contact surfaces 58A and the developer-seal contact surfaces 92A so as to be exposed therefrom, as shown in FIGS. 12A and 12B. Here, the exposed depressed portions in the frame-seal contact surfaces 58A are referred to as frame-seal depressed portions 58B as an example of second depressed portions, and the exposed depressed portions in the developer-seal contact surfaces 92A are referred to as developer-seal depressed portions 92B as an example of first depressed portions.

Here, the opening size of each depressed portion in the corresponding contact surfaces is referred to as an opening area and the distance from the corresponding contact surface to the bottom of each depressed portion is referred to as a depressed portion depth. That is, the opening area 58C of one frame-seal depressed portion 58B is a hatched region in FIG. 12A (see FIG. 13A). The depth 58D of one frame-seal depressed portion 58B is a size indicated in the frame-seal depressed portion 58B at the leftmost side in FIG. 13A. The opening area 92C of one developer-seal depressed portion 92B is a hatched region in FIG. 12B (see FIG. 13B). The depth 92D of one developer-seal depressed portion 92B is a size indicated in the developer-seal depressed portion 92B at the leftmost side in FIG. 13B.

As shown in FIGS. 12A and 12B, the number of frame-seal depressed portions 58B is greater than the number of developer-seal depressed portions 92B in a predetermined area (where the frame-seal contact surface 58A and the developer-seal contact surface 92A have the same size). Specifically, the frame-seal depressed portions 58B are dispersed almost uniform in the entire frame-seal contact surface 58A. Particularly, the frame-seal depressed portions 58B are dispersed uniform at least in the direction (in the lateral direction in FIG. 12A) perpendicular to the direction (in which the frame-seal contact surfaces 58A come in sliding contact with the developer-seal contact surfaces 92A and which is indicated by a solid arrow in FIG. 12A) parallel to the first movement direction. Here, the frame seals 58 (at least the frame-seal contact surfaces 58A) may be formed of continuous bubble foams as well as independent bubble foams, or the neighboring frame-seal depressed portions 58B may be connected to each other (see the portion indicated by the dotted line in FIG. 12A). The number of developer-seal depressed portions 92B is preferably still smaller than the number of frame-seal depressed portions 58B.

Here, the opening area 58C of one frame-seal depressed portion 58B is set to be greater than the opening area 92C of one developer-seal depressed portion 92B. Accordingly, the average of the opening areas 58C of all the frame-seal depressed portions 58B is greater than the average of the opening areas 92C of all the developer-seal depressed portions 92B.

As shown in FIGS. 13A and 13B, the depth 58D of one frame-seal depressed portion 58B is greater than the depth 92D of one developer-seal depressed portion 92B. Accordingly, the average of the depths 58D of all the frame-seal depressed portions 58B is greater than the average of the depths 92D of all the developer-seal depressed portions 92B.

Since the frame seals 58 having the above-mentioned frame-seal depressed portions 58B can capture more developer by the frame-seal depressed portions 58B than the developer seals 92, it has a great developer capturing force.

The developer seals 92 are formed of the above-mentioned Poron (made by ROGERS INOAC Corporation) and as shown in FIG. 14, have a two-layer structure including a first portion (hatched portion) 92E and a second portion 92F. Since the first portion 92E is a so-called skin layer and comes in contact with the frame seals 58, the contact surface of the first portion 92E with the frame seals 58 is the above-mentioned developer-seal contact surface 92A. In the state where the first portion 92E is in contact with the frame seals 58, the second portion 92F is disposed opposite to the frame seals 58 about the developer seals 92. That is, the second portion 92F supports the first portion 92E as a base (a portion bonded to the inside housing 81) of the developer seals 92. Here, the second portion 92F is set to be smaller in elastic modulus than the first portion 92E.

It is preferable that the frame seals 58 (at least the frame-seal contact surfaces 58A) are formed of a material closer to the negative polarity (opposite side of the positive polarity which is the charging polarity of the developer) than the material of the developer seals 92 (at least the developer-seal contact surfaces 92A) in the charging table. Here, the charging table is an arrangement in which materials easily charged into the positive are arranged in the higher rank and materials easily charged into the negative are arranged in a lower rank when two kinds of materials rub each other.

Specifically, examples of the materials of the developer seal 92 or the frame seal 58 can include nylon, polyester, urethane, polyethylene, polystyrene, and silicon sequentially from the positive in the charging table. The developer seal 92 is formed of a material close to the positive and the frame seal 58 is formed of a material closer to the negative than the material of the developer seal 92 in the charging table. For example, when the developer seal 92 is formed of urethane, the frame seal 58 may be formed of silicon. When the developer seal 92 is formed of nylon, the frame seal 58 may be formed of urethane.

In the process cartridge 17, as shown in FIGS. 2A and 2B, when the developer cartridge 31 is held in the cartridge holding part 33 and the inside housing 81 is located at the first opening position, the inside passage holes 89 are opened. Accordingly, the developer accommodated in the developer cartridge 31 (specifically, in the inside housing 81) can be supplied to the developing roller 37 of the process frame 22 through the opened inside passage holes 89. In contrast, when the inside housing 81 is located at the first closing position, the inside passage holes 89 are closed (see FIGS. 11A and 11B). Accordingly, the developer cartridge 31 can be detached from the process frame 22 without allowing the developer accommodated in the inside housing 81 to leak from the inside passage holes 89.

Here, in the inside housing 81, the developer seals 92 are disposed around the inside passage holes 89 (see FIGS. 8A and 8B). Accordingly, when the inside housing 81 is located at the first opening position, it is possible to prevent the developer accommodated in the inside housing 81 from not being supplied to the developing roller 37 but leaking around the inside passage holes 89.

The developer can be easily attached to the developer seals 92. When the inside housing 81 moves from the first opening position to the first closing position in the state where the developer is attached to the developer seals 92 and the lower edges 110A of the developer seals 92 come in contact with the contact portions 118 in the outside passage holes 102 of the outside circumferential wall 97 as shown in FIG. 10B, the developer attached to the lower edges 110A can be transferred from the contact portions 118 to the outside housing 82.

However, in the process cartridge 17, the frame seals 58 having the greater developer capturing force than the developer seals 92 come in sliding contact with the developer seals 92 when the inside housing 81 moves from the first opening position to the first closing position. Accordingly, the developer attached to the developer seals 92 is captured by the frame seals 58 during the movement of the inside housing 81. As a result, until the inside housing 81 reaches the first closing position, the developer attached to the developer seals 92 are removed without being attached to the outside housing 82. Accordingly, even when a user accesses the outside housing 82 so as to detach the developer cartridge 31 from the process frame 22, it is possible to prevent the user's hand from being contaminated by the developer.

As a result, it is possible to improve the usability.

As described above, by forming the frame seals 58 and the developer seals 92 out of foamed materials, the depressed portions (frame-seal depressed portions 58B and developer-seal depressed portions 92B) are formed to be exposed in the frame-seal contact surfaces 58A and the developer-seal contact surfaces 92A, as shown in FIGS. 12 and 13. In addition, by setting the average of the opening areas 58C of the frame-seal depressed portions 58B to be greater than the average of the opening areas 92C of the developer-seal depressed portions 92B, the developer attached to the developer-seal contact surfaces 92A (specifically, the developer-seal depressed portions 92B) can be more easily transferred to the frame-seal depressed portions 58B, when the frame seals 58 come in sliding contact with the developer seals 92. That is, it is possible to make the developer capturing force of the frame seals 58 greater than the developer capturing force of the developer seals 92. Particularly, the frame-seal depressed portions 58B are dispersed substantially uniform in the entire frame-seal contact surfaces 58A as described above. Accordingly, when the frame seals 58 (the frame-seal contact surfaces 58A) come in sliding contact with the developer-seal contact surfaces 92A, the developer attached to the developer-seal contact surfaces 92A can be captured without any inclination in the developer-seal contact surfaces 92A.

The average depth of the frame-seal depressed portions 58B is greater than the average depth of the developer-seal depressed portions 92B (see the depth 58D and the depth 92D in FIGS. 13A and 13B). Accordingly, when the frame seals 58 come in sliding contact with the developer seals 92, the developer attached to the developer-seal depressed portions 92B can be further easily transferred to the frame-seal depressed portions 58B. That is, the developer capturing force of the frame seals 58 can be set to be greater than the developer capturing force of the developer seals 92.

As described above, in the developer seals 92 shown in FIG. 14, the second portion 92F disposed opposite to the frame seals 58 about the first portion 92E in the state where the first portion 92E is in contact with the frame seals 58 is smaller in elastic modulus (more easily deformed elastically) than the first portion 92E. Accordingly, since the first portion 92E is pressed on the frame seals 58 with the restoring force of the second portion 92F elastically deformed, it is possible to reliably bring the first portion 92E into contact with the frame seals 58. As a result, when the inside housing 81 moves from the first opening position to the first closing position, the frame seals 58 can reliably come in sliding contact with the developer seals 92 and capture the developer attached to the developer seals 92.

As described above, it is preferable that the frame-seal contact surfaces 58A are formed of a material closer to the second polarity (negative) opposite to the first polarity (positive) which is the charging polarity of the developer than the material of the developer-seal contact surfaces 92A in the charging table. Accordingly, when the frame seals 58 come in sliding contact with the developer seals 92, the developer charged into the positive can be easily transferred from the developer-seal contact surfaces 92A to the frame-seal contact surfaces 58A. This is because the frame-seal contact surfaces 58A are charged closer to the negative than the developer-seal contact surfaces 92A. That is, the developer capturing force of the frame seals 58 can be made to be greater than the developer capturing force of the developer seals 92.

In the process cartridge 17, as shown in FIGS. 2A and 2B, when the inside housing 81 is located at the first opening position, the frame-side passage holes 34 of the process frame 22 are opposed to the inside passage holes 89, whereby the inside passage holes 89 and the frame-side passage holes 34 communicate with each other. Accordingly, the developer accommodated in the inside housing 81 can be supplied to the developing roller 37 of the process frame 22 through the inside passage holes 89 and the frame-side passage holes 34.

Since the frame seals 58 disposed around the frame-side passage holes 34 come in contact with the developer seals 92, the developer can be prevented from leaking between the inside passage holes 89 and the frame-side passage holes 34. Since the frame seals 58 have both the function of preventing the leakage of the developer and the function of capturing the developer from the developer seals 92, it is not necessary to individually provide components having the functions, thereby reducing the number of components.

As shown in FIG. 10B, the lower edges 110A of the developer seals 92 are exposed from the frame-side passage holes 34, when the inside housing 81 moves from the first opening position to the first closing position. Accordingly, the developer in the frame-side passage holes 34 can be easily attached to the lower edges 110A (particularly, the developer-seal contact surfaces 92A). However, since the lower edges 110A are first exposed from the frame-side passage holes 34 and then come in sliding contact with the upper edges 61B of the frame seals 58, the developer attached to the lower edges 110A when the lower edges of the developer seals 92 are exposed from the frame-side passage holes 34 is reliably captured by the upper edges 61B (frame-seal contact surfaces 58A) of the frame seals 58. Accordingly, until the inside housing 81 reaches the first closing position, the developer attached to the lower edges 110A of the developer seals 92 is removed without being attached to the outside housing 82. Accordingly, even when a user accesses the outside housing 82 to detach the developer cartridge 31 from the process frame 22, it is possible to prevent the user's hand from being contaminated by the developer.

Since the first movement direction of the inside housing 81 from the first opening position to the first closing position is upward, the developer can be easily attached to the lower edges 110A of the developer seals 92. However, since the lower edges 110A are first exposed from the frame-side passage holes 34 and then come in sliding contact with the upper edges 61B of the frame seals 58, the developer attached to the lower edges 110A of the developer seals 92 is reliably captured by the upper edges 61B of the frame seals 58.

By allowing the shutter 68 to move between the second opening position and the second closing position, it is possible to open and close the frame-side passage holes 34. In spite of the shutter 68, when the inside housing 81 is located at the first opening position and the shutter 68 is located at the second opening position, the developer seals 92 come in contact with the frame seals 58, as shown in FIGS. 2A and 2B. Accordingly, when the inside housing 81 moves from the first opening position to the first closing position, the frame seals 58 can reliably come in sliding contact with the developer seals 92 and capture the developer attached to the developer seals 92.

Here, the shutter 68 is disposed closer to the inside passage holes 89 than the frame seals 58 with respect to the frame-side passage holes 34 and the shutter 68 is provided with the protruding portions 76. As shown in FIG. 2B, the ends (the block portions 41 of the sheet 40) of the protruding portions 76 close to the inside passage holes 89 (close to the cartridge holding part 33) protrude more upward than the ends (lower edges 68A) close to the frame-side passage holes 34 (more apart from the cartridge holding part 33 than the inside passage holes 89). Accordingly, even when the developer captured from the developer seals 92 by the frame seals 58 is attached to the shutter 68 (specifically, the lower edges 68A), the developer is intercepted from the inside passage holes 89 by the protruding portions 76, thereby preventing the developer from overflowing and flying from the cartridge holding part 33.

The protruding portions 76 are disposed in the circumferential edges (specifically, the lower edges 68A) in the shutter openings 69 of the shutter 68. However, the shutter 68 may have a simple plate shape not having the shutter openings 69. In this case, the protruding portions 76 may be formed at positions of the outer edge of the shutter 68 to which the developer captured by the frame seals 58 can be easily attached.

MODIFIED EXAMPLES

(1) Modified Example 1

In the above-described exemplary embodiments, as shown in FIG. 1, the process cartridge 17 monolithically has the photosensitive drum 25 and the developing roller 37, and the process cartridge 17 is detachably attached to the body casing 2. In addition, for example, the process cartridge 17 may be formed by a developing cartridge not having the photosensitive drum 25 and a particular unit (drum cartridge) having the photosensitive drum 25 may be provided, where the developing cartridge may be detachably attached to the drum cartridge. The process cartridge 17 may be attached to the body casing 2 and only the developer cartridge 31 may be detachable.

The body casing 2 may be provided with the photosensitive drum 25, the scorotron-type charger 26, and the transfer roller 28 and the developing cartridge may be detachably attached to the body casing 2. Here, the developer cartridge 31 is attachable to and detachable from the developing cartridge, and the shutter 68 is disposed in the developing cartridge.

(2) Modified Example 2

Although exemplary embodiments of the inventive concept have been described in relation to a laser printer, the present inventive concept is not limited to a monochrome laser printer. Rather, the present inventive concept can also be applied to a color laser printer, including a tandem type and an intermediate transfer type printer.

(3) Modified Example 3

As shown in FIGS. 12 and 13, it is preferable that the average S of the opening area 92C (where the opening area 92C is an area of a circle) of all the developer-seal depressed portions 92B and the average particle size L (about 6 to 10 μm) of the developer satisfy the following relation.

$$2(S/\Pi)^{0.5}<L$$

Accordingly, since the average opening diameter of the developer-seal depressed portions 92B in the developer-seal contact surfaces 92A is smaller than the average particle size L of the developer, it is possible to prevent the developer from being attached to the developer-seal depressed portions 92B. As a result, until the inside housing 81 reaches the first closing position, it is possible to further prevent the developer from moving from the developer seals 92 to the outside housing 82.

In contrast, it is preferable that the average R of the opening areas 58C (where the opening area 92C is an area of a circle) of all the frame-seal depressed portions 58B and the average particle size L of the developer satisfy the following relation:

$$2(R/\Pi)^{0.5}<L$$

Accordingly, since the average opening diameter of the frame-seal depressed portions 58B in the frame-seal contact surfaces 58A is greater than the average particle size L of the developer, the developer can be reliably transferred to the frame-seal depressed portions 58B.

(4) Modified Example 4

In the above-described exemplary embodiments, the frame seals 58 and the developer seals 92 are formed of foamed materials. However, whether the seals are formed of the foamed materials or not, the surface roughness of the frame-seal contact surfaces 58A may be set to be greater than the surface roughness of the developer-seal contact surfaces 58A, for example, on the basis of the ten-point average roughness (Rz). Then, the frame-seal depressed portions 58B greater than (larger and deeper in opening area) the developer-seal depressed portions 92B are necessarily formed in the frame-seal contact surfaces 58A (see FIGS. 12 and 13).

Accordingly, when the frame-seals 58 come in sliding contact with the developer seals 92, the developer attached to the developer-seal contact surfaces 92A can be easily transferred to the frame-seal contact surfaces 58A. That is, the developer capturing force of the frame-seals 58 can be made to be greater than the developer capturing force of the developer seals 92.

(5) Modified Example 5

The frame seals 58 and the developer seals 92 may be formed of the same materials and the density of the frame seals 58 may be set to be smaller than the density of the developer seals 92.

Accordingly, it is possible to secure the more space for capturing the developer in the frame seals 58 than in the developer seals 92. For example, when the contact surfaces of the developer seals 92 and the frame seals 58 are formed of the same foamed material, the frame-seal depressed portions 58B larger than the developer-seal depressed portions 92B are formed in the frame-seal contact surfaces shown in FIGS. 12A and 12B. Accordingly, when the frame seals 58 come in sliding contact with the developer seals 92, the developer attached to the developer-seal depressed portions 92B can be easily transferred to the frame-seal depressed portions 58B. That is, the developer capturing force of the frame-seals 58 can be made to be greater than the developer capturing force of the developer seals 92.

(6) Modified Example 6

In the above-described exemplary embodiments, the frame seals 58 (the frame-seal contact surfaces 58A) and the developer seals 92 (the developer-seal contact surfaces 92A) are both formed of the foamed materials. Instead, the frame-seal contact surfaces 58A may be formed of the foamed material but the developer-seal contact surfaces 92A may be formed of a non-foamed material (a smooth film not having the developer-seal depressed portions 92B).

Accordingly, when the frame seals 58 come in sliding contact with the developer seals 92, the developer attached to the developer-seal contact surfaces 92A can be easily transferred to the frame-seal contact surfaces 58A (the frame-seal depressed portions 58B in the frame-seal contact surfaces formed of the foamed material). That is, the developer capturing force of the frame-seals 58 can be made to be greater than the developer capturing force of the developer seals 92.

(7) Modified Example 7

Figures 15A, 15B:
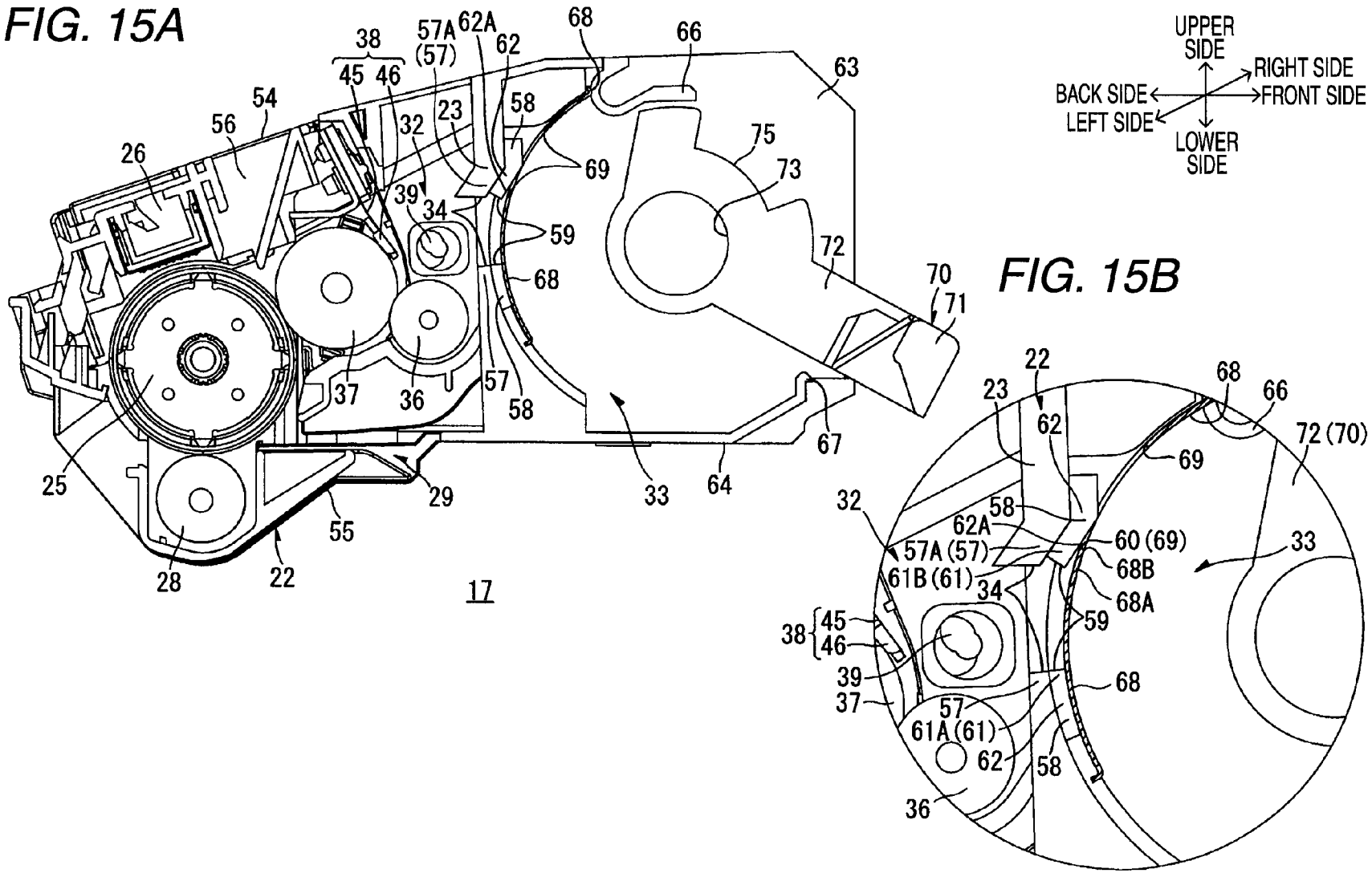
FIGS. 15A and 15B are diagrams showing Modified Example 7 applied to FIGS. 3A and 3B.

FIGS. 15A and 15B are diagrams showing Modified Example 7 applied to FIGS. 3A and 3B. In FIGS. 15A and 15B, the sheet 40 and the shutter guide portions 78 shown in FIGS. 3A and 3B are omitted for the purpose of convenient explanation.

In Modified Example 7, as shown in FIG. 15B, slopes 62A as an example of the contact surface are formed in the portions (portions more downstream in the second movement direction than the frame-side passage holes 34, which are referred to as upside portions 62) of the frame seals 58 above the cutout portions 59. The slopes 62A forms the front side surfaces below the upside portions 62 and extend to be obliquely inclined to the rear downside (that is, to the frame-side passage holes 34).

Here, the slopes 62A face the upper ends 68B which are the lower ends of the shutter openings 69 of the shutter 68 from the upside when the shutter 68 is located at the second opening position. Accordingly, when the shutter 68 moves upward from the second opening positions to the second closing positions, the slopes 62A come in contact with the upper ends 68B. The slopes 62A extend to be obliquely inclined to the rear downside, that is, extend obliquely to the front upside. Accordingly, the contact pressure 62A of the slopes 62A on the upper ends 68B gradually increases as the shutter 68 moves upward from the second opening position to the second closing position.

Accordingly, when the shutter 68 moves from the second opening position to the second closing position, it is possible to prevent the developer captured from the developer seals 92 by the frame seals 58 from flying from the slopes 62 due to the sudden contact of the slopes 62A with the upper ends 68B of the shutter 68.

Here, in the curved portion 57 of the partition wall 23, the portions supporting the portions of the frame seals 58 corresponding to the slopes 62A are supporting portions 57A. Since the supporting portions 57A are inclined to the frame-side passage holes 34 (developing part 32) (that is, obliquely to the rear downside) as it goes down, the slopes 62A are necessarily formed in the portions of the frame seals 58 supported by the supporting portions 57A. Accordingly, the contact pressure of the slopes 62A on the upper ends 68B can be made to increase as the shutter 68 moves from the second opening position to the second closing position.

Here, the upper ends 68B of the shutter openings 69 of the shutter 68 come in contact with the slopes 62A, but the invention is not limited to the configuration. For example, edges of the shutter 68 other than the upper ends 68B may come in contact with the slopes 62A. In this case, the contact pressure of the slopes 62A on the edges increases as the shutter 68 moves upward from the second opening position to the second closing position.

(8) Modified Example 8

Figures 16A, 16B:
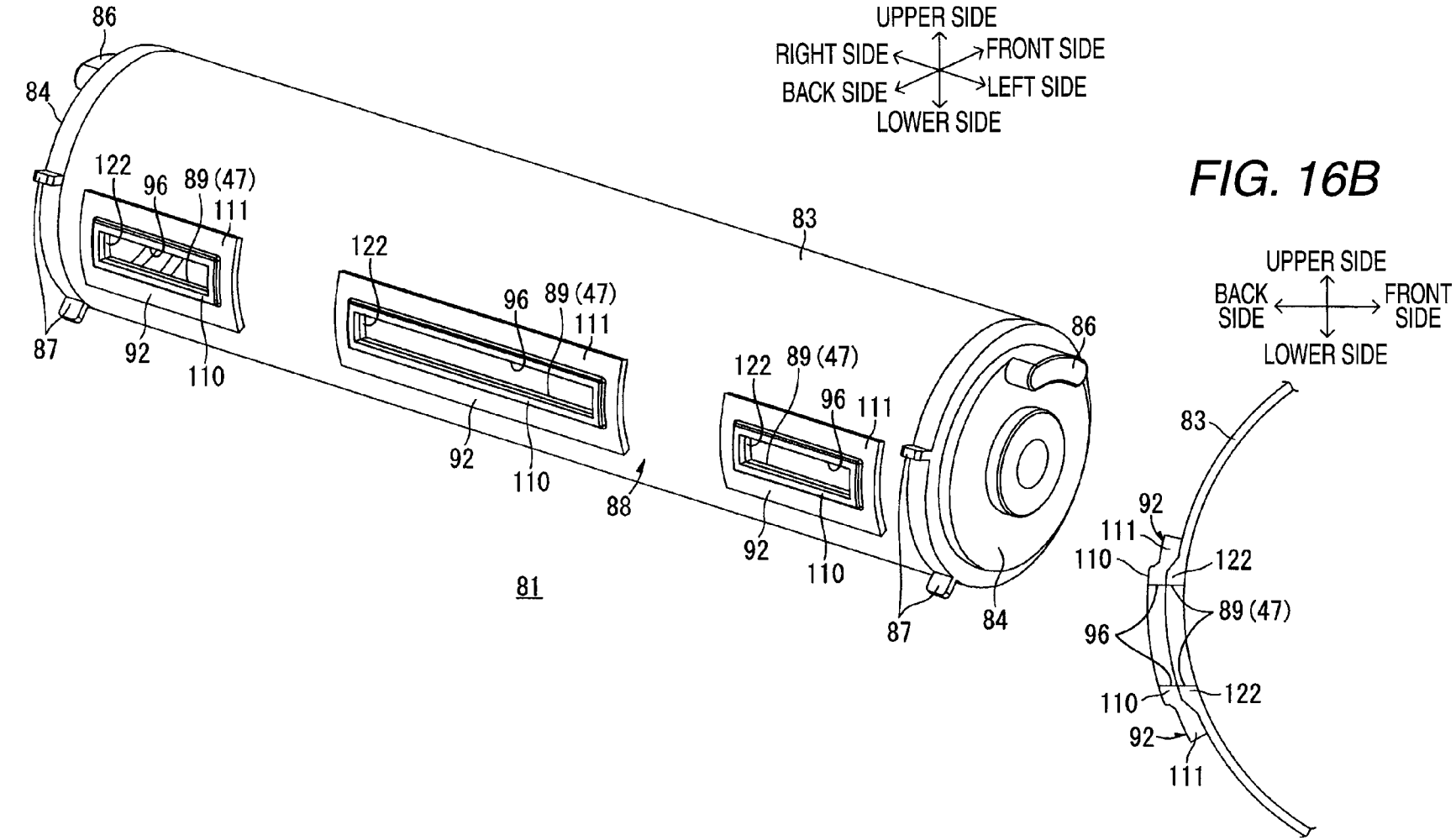
FIGS. 16A and 16B are diagrams showing Modified Example 8 applied to FIGS. 8A and 8B.
Figures 17A, 17B:
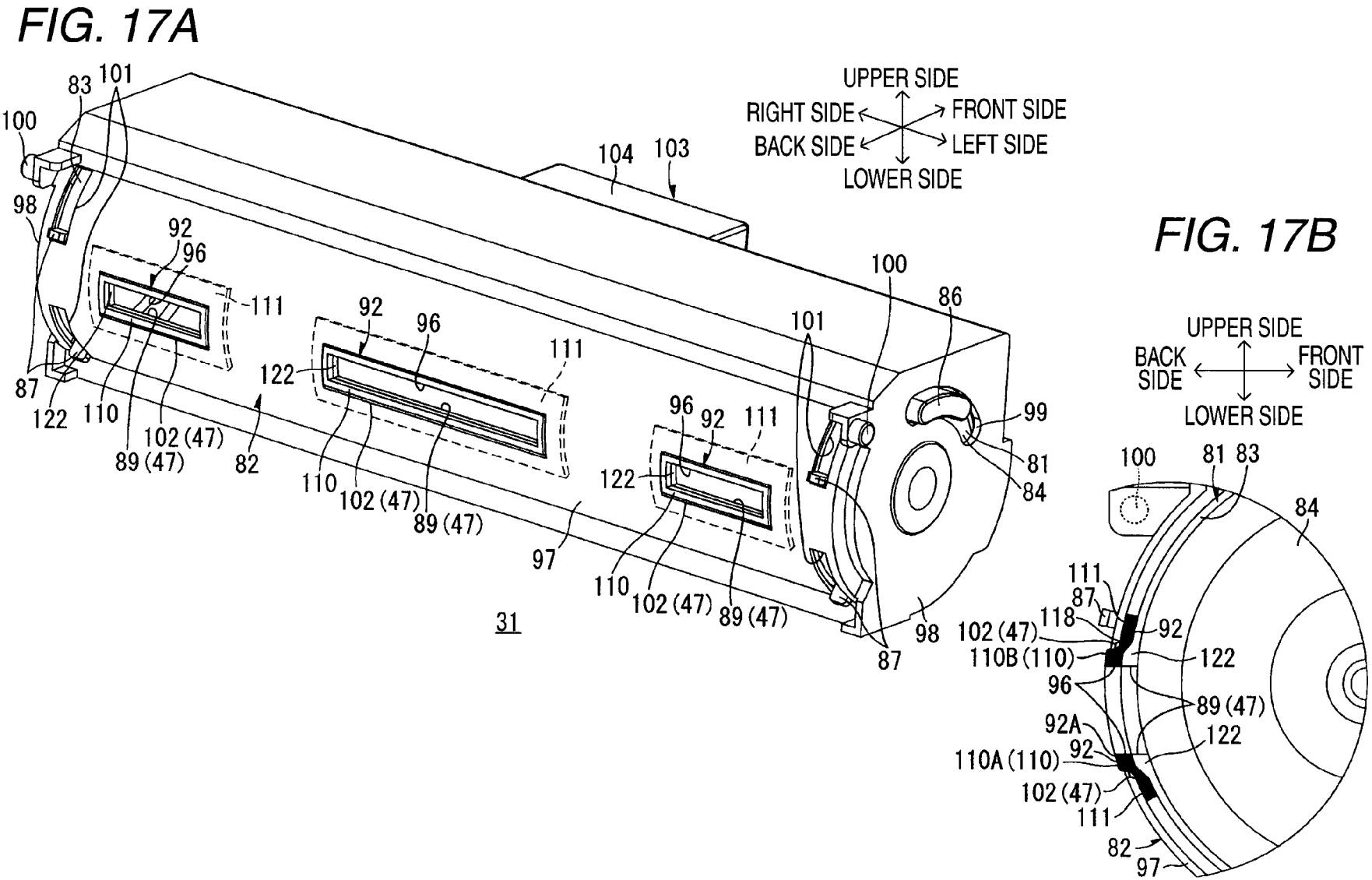
FIG. 17A is a perspective view of a developer cartridge according to Modified Example 8 as obliquely viewed from the rear left side, showing a state where the inside housing is located at the first opening position.
FIG. 17B is a partial sectional view of the developer cartridge shown in FIG. 17A around the cartridge-side passage hole.

FIG. 16A is a diagram showing Modified Example 8 applied to FIG. 8A. FIG. 16B is a diagram showing Modified Example 8 applied to FIG. 8B. FIG. 17A is a perspective view showing the developer cartridge (a state where the inside housing is located at the first opening position) according to Modified Example 8 as viewed obliquely from the rear left side and FIG. 17B is a partial sectional view of the developer cartridge shown in FIG. 17A around the cartridge-side passage hole. In FIG. 17B, the developer seals are colored for the purpose of convenient explanation. The inside housing 81 and the developer cartridge 31 shown in FIGS. 16 and 17 are slightly different from the inside housing 81 and the developer cartridge 31 shown in FIGS. 8 and 9, in portions other than the featured portions of Modified Example 8.

In the developer cartridge 31 according to Modified Example 8, as shown in FIGS. 16A and 16B, protrusions 122 are disposed in the circumferential edges of the inside passage holes 89 formed in the outer circumferential surface of the inside circumferential wall 83 of the inside housing 81. The protrusions 122 are disposed over the entire circumference of the circumferential edges of the inside passage holes 89 and are formed to protrude outward (outward in the diameter direction of the inside circumferential wall 83 and to the rear side in FIGS. 16A and 16B) from the inside housing 81 (see FIG. 16B). Specifically, the protrusions 122 have substantially a rectangular shape surrounding the edge of the corresponding inside passage hole 89 as viewed from the rear side (from the outside in the diameter direction). The downstream end surface (rear end surface in FIGS. 16A and 16B) in the protruding direction of the protrusions 122 form a substantially flat plane.

The developer seals 92 are bonded to the inside circumferential wall 83 so that the edges of the cutout portions 96 correspond to the protrusions 122. That is, the end portions of the substantially rectangular shape (the inside edges 110) forming the cutout portions 96 in the developer seals 92 are disposed on the protrusions 122. Specifically, the portions (the outside edges 111) of the developer seals 92 other than the inside edges 110 are bonded to the outer circumferential surface of the inside circumferential wall 83. In contrast, since the inside edges 110 are disposed on the protrusions 122, the inside edges protrude more outward in the diameter direction by a step than the outside edges 111 (see FIG. 16B).

Accordingly, as shown in FIGS. 17A and 17B, when the inside housing 81 is located at the opening position, all the inside edges 110 of the developer seals 92 are exposed from the corresponding outside passage holes 102 and protrude outward in the diameter direction from the outside circumferential wall 97 (see FIG. 17B). In this way, when the developer cartridge 31 having the protrusions 122 are attached to the process frame 22 and the inside housing 81 is located at the first opening position, the inside edges 110 (specifically, the lower edges 110A) of the developer seals 92 are pressed to the frame seals 58 (specifically, the lower edges 61A) by the protrusions 122 with the pressure greater than that of the case not having the protrusions 122.

Accordingly, when the inside housing 81 moves from the first opening position to the first closing position, the frame seals 58 can reliably come in sliding contact with the developer seals 92 and capture the developer attached to the developer seals 92.

As well as the case using the protrusions 122, by allowing the developer seals 92 to protrude outward from the inside passage holes 89 when the inside housing 81 moves from the first opening position to the first closing position, the frame seals 58 can reliably come in sliding contact with the developer seals 92 and capture the developer attached to the developer seals 92. The developer seals 92 can plug the space between the inside housing 81 and the outside housing 82, since the developer seals protrude outward from the inside passage holes 89. Accordingly, it is possible to prevent the developer from leaking from the inside passage holes 89 to the space between the inside housing 81 and the outside housing 82.

According to another aspect of the invention, the first seal comprises a first contact portion that is contactable with the capturing member, the capturing member (58) comprises a second contact portion (58A) that is contactable with the first seal, and a surface roughness of the second contact portion is greater than a surface roughness of the first contact portion on the basis of a ten-point average roughness.

According thereto, by making the surface roughness of the contact portion of the capturing member with the first seal greater than the surface roughness of the contact portion of the first seal with the capturing member on the basis of the ten-point average roughness, the developer attached to the contact portion of the first seal can be easily transferred to the contact portion of the capturing member when the capturing member comes in sliding contact with the first seal. That is, the developer capturing force of the capturing member can be made to be greater than the developer capturing force of the first seal.

According to still another aspect of the invention, the first seal comprises a first contact portion that is contactable with the capturing member, the capturing member comprises a second contact portion that is contactable with the first seal, the first contact portion is formed of a foamed material and comprises a plurality of first depressed portions exposed on a surface thereof, the second contact portion is formed of the foamed material and comprises a plurality of second depressed portions exposed on a surface thereof, and an average opening area of the second depressed portions is greater than an average opening area of the first depressed portions.

According thereto, by forming the contact portion of the capturing member with the first seal and the contact portion of the first seal with the capturing member out of a foamed material, depressed portions are exposed in the contact portions. By making the average opening area of the exposed depressed portions in the contact portion of the capturing member greater than the average opening area of the exposed depressed portions in the contact portion of the first seal, the developer attached to the contact portion of the first seal can be easily transferred to the contact portion of the capturing member when the capturing member comes in sliding contact with the first seal. That is, the developer capturing force of the capturing member can be made to be greater than the developer capturing force of the first seal.

According to still another aspect of the invention, an average depth of the second depressed portions is greater than an average depth of the first depressed portions.

According thereto, the average depth of the exposed depressed portions in the contact portion of the capturing member is greater than the average depth of the exposed depressed portions in the contact portion of the first seal. Accordingly, the developer attached to the contact portion of the first seal can be more easily transferred to the contact portion of the capturing member when the capturing member comes in sliding contact with the first seal. That is, the developer capturing force of the capturing member can be made to be greater than the developer capturing force of the first seal.

According to still another aspect of the invention, the average opening area S of the first depressed portions and an average particle size L of the developer satisfy the following relation:

$$2(S/\Pi)^{0.5}<L.$$

According thereto, it is possible to prevent the developer from being attached to the depressed portions of the contact portion of the first seal. Accordingly, until the inside frame reaches the first closing position, it is possible to further prevent the developer from being transferred from the first seal to the outside frame.

According to still another aspect of the invention, the first seal comprises: a first portion that is contactable with the capturing member (58); and a second portion that is provided on an opposite side of the capturing member with respect to the first portion when the first portion contacts with the capturing member, the second portion having an elastic modulus that is smaller than an elastic modulus of the first portion.

According thereto, the second portion of the first seal disposed opposite to the capturing member about the first portion in a state where the first portion is in contact with the capturing member is smaller in elastic modulus (can be more easily deformed elastically) than the first portion. Accordingly, since the first portion is pressed against the capturing member with a restoring force of the elastically deformed second portion, it is possible to reliably make the first portion come in contact with the capturing member. As a result, when the inside frame moves from the first opening position to the first closing position, the capturing member can reliably come in sliding contact with the first seal and capture the developer attached to the first seal.

According to still another aspect of the invention, the first seal and the capturing member are formed of the same material, and a density of the capturing member is lower than that of the first seal.

According thereto, when the first seal and the capturing member are formed of the same material and the density of the capturing member is smaller than the density of the first seal, the capturing member can secure a space for capturing the developer more than that of the first seal. For example, when the first seal and the capturing member are formed of the same foamed material, greater depressed portions are formed in the contact portion of the capturing member than the contact portion of the first seal. Accordingly, the developer attached to the contact portion (depressed portions) of the first seal can be easily transferred to the contact portion (depressed portions) of the capturing member when the capturing member comes in sliding contact with the first seal. That is, the developer capturing force of the capturing member can be made to be greater than the developer capturing force of the first seal.

According to still another aspect of the invention, the second contact portion is formed of a foamed material, and the first contact portion is formed of a non-foamed material.

According thereto, by forming the contact portion of the capturing member with the first seal out of a foamed material and forming the contact portion of the first seal with the capturing member out of a non-foamed material, the developer attached to the contact portion of the first seal can be easily transferred to the contact portion (the depressed portions in the contact portion formed of the foamed material) of the capturing member when the capturing member comes in sliding contact with the first seal. That is, the developer capturing force of the capturing member can be made to be greater than the developer capturing force of the first seal.

According to still another aspect of the invention, the developer is charged into a first polarity, and the second contact portion is formed of a material having a polarity that is closer to a second polarity, which is opposite to the first polarity, than a polarity of a material of the first contact portion in a charging table.

According thereto, the contact portion of the capturing member with the first seal is formed of a material closer to the second polarity opposite to the first polarity which is the charging polarity of the developer than the material of the contact portion of the first seal with the capturing member in the charging table. Accordingly, when the capturing member comes in sliding contact with the first seal, the contact portion of the capturing member is charged into the second polarity. As a result, the developer charged into the first polarity can be easily transferred from the contact portion of the first seal to the contact portion of the capturing member. That is, it is possible to make the developer capturing force of the capturing member greater than the developer capturing force of the first seal.

According to still another aspect of the invention, the housing comprises a second opening that faces the cartridge holding part and is locatable in a position opposed to the first opening when the inside frame is located at the first opening position, the developing unit further comprises a second seal that is provided around the second opening and is capable of preventing the developer from leaking between the first opening and the second opening by contacting with the first seal, and the second seal comprises the capturing member.

According thereto, when the inside frame is located at the first opening position, the second opening of the housing is opposed to the first opening to make the first opening and the second opening communicate with each other. Accordingly, the developer accommodated in the developer cartridge can be supplied to the developer holding member in the housing through the first opening and the second opening.

By allowing the second seal disposed around the second opening to come in contact with the first seal, it is possible to prevent the developer from leaking between the first opening and the second opening. Since the second seal includes the capturing member, it is not necessary to individually provide the second seal and the capturing member, thereby reducing the number of components.

According to still another aspect of the invention, a portion of the first seal more upstream than the first opening in a first movement direction of the inside frame from the first opening position to the first closing position is exposed to the second opening when the inside frame moves from the first opening position to the first closing position and slide contacts with a portion of the capturing member more downstream than the second opening in the first movement direction.

According thereto, a portion of the first seal more upstream than the first opening in the first movement direction of the inside frame from the first opening position to the first closing position is exposed to the second opening when the inside frame moves from the first opening position to the first closing position. Accordingly, the developer in the second opening can be easily attached to the upstream portion. However, the upstream portion of the first seal comes in sliding contact with the more downstream portion of the capturing member than the second opening in the first movement direction after being exposed to the second opening. Accordingly, the attached developer when the upstream portion of the first seal is exposed to the second opening is reliably captured by the downstream portion of the capturing member. As a result, until the inside frame reaches the first closing position, the developer attached to the upstream portion of the first seal is not attached to the outside frame but removed. Accordingly, even when a user accesses the outside frame to detach the developer cartridge from the housing, it is possible to prevent the user's hand from being contaminated by the developer.

According to still another aspect of the invention, the first movement direction is upward.

According thereto, since the first movement direction of the inside frame from the first opening position to the first closing position is upward, the developer can be easily attached to the more upstream portion of the first seal than the first opening in the first movement direction. However, since the upstream portion of the first seal is exposed to the second opening and then comes in sliding contact with the more downstream portion of the capturing member than the second opening in the first movement direction, the developer attached to the upstream portion of the first seal can be reliably captured by the downstream portion of the capturing member.

According to still another aspect of the invention, the developing unit further comprises a shutter that is provided closer to the first opening than the capturing member with respect to the second opening in the housing and is movable between a second opening position where the second opening is opened and a second closing position where the second opening is closed, wherein, when the inside frame is located at the first opening position and the shutter is located at the second opening position, the first seal is contactable with the capturing member.

According thereto, the second opening can be opened and closed by allowing the shutter to move between the second opening position and the second closing position. In spite of the shutter, when the inside frame is located at the first opening position and the shutter is located at the second opening position, the first seal comes in contact with the capturing member. Accordingly, when the inside frame moves from the first opening position to the first closing position, the capturing member can reliably come in sliding contact with the first seal and capture the developer attached to the first seal.

According to still another aspect of the invention, the developing unit further comprises: a shutter that is provided closer to the first opening than the capturing member with respect to the second opening in the housing and is movable between a second opening position where the second opening is opened and a second closing position where the second opening is closed; and a protruding portion that is provided in the shutter, an end thereof close to the first opening protruding more downstream in a second movement direction of the shutter from the second opening position to the second closing position than the end close to the second opening.

According thereto, the second opening can be opened and closed by allowing the shutter to move between the second opening position and the second closing position. Here, the shutter is disposed closer to the first opening than the capturing member with respect to the second opening and the protruding portion is disposed in the shutter. In the protruding portion, the end close to the first opening (close to the cartridge holding part) protrudes more downstream than the end close to the second opening (more apart from the cartridge holding part than the first opening) in the second movement direction of the shutter from the second opening position to the second closing position. Accordingly, even when the developer captured from the first seal by the capturing member is attached to the shutter, the developer is intercepted from the first opening side by the protruding portion. As a result, it is possible to prevent the developer from overflowing and flying from the cartridge holding part.

According to still another aspect of the invention, the capturing member comprises a contact surface in a portion of the capturing member more downstream in a second movement direction of the shutter from the second opening position to the second closing position than the second opening, the contact surface being contactable with an end of the shutter moving from the second opening position to the second closing position, the contact surface extends to the second opening, a contact pressure of the contact surface on the end of the shutter increases as the shutter moves from the second opening position to the second closing position, and a portion of the housing supporting a portion of the capturing member corresponding to the contact surface is inclined toward the second opening as approaching upstream in the second movement direction.

According thereto, the contact surface formed in the portion of the capturing member more downstream than the second opening in the second movement direction of the shutter from the second opening position to the second closing position comes in contact with the end of the shutter moving from the second opening position to the second closing position. Here, the contact pressure of the contact surface on the end of the shutter increases as the shutter moves from the second opening position to the second closing position. Accordingly, when the shutter moves from the second opening position to the second closing position, it is possible to prevent the developer captured from the first seal by the capturing member from being flied from the contact surface due to the sudden contact of the contact surface with the end of the shutter.

By inclining the portion of the housing supporting the portion of the capturing member corresponding to the contact surface toward the second opening as it goes upstream in the second movement direction, the contact pressure of the contact surface on the end of the shutter can be made to increase as the shutter moves from the second opening position to the second closing position.

According to still another aspect of the invention, the developing unit further comprises a protrusion that is provided in a circumferential edge of the first opening of the inside frame with protruding outward from the inside frame, the protrusion being capable of pressing the first seal toward the capturing member.

According thereto, the protrusion formed in the circumferential edge of the first opening on the inside frame protrudes outward from the inside frame and presses the first seal toward the capturing member. Accordingly, when the inside frame moves from the first opening position to the first closing position, the capturing member can reliably come in sliding contact with the first seal and capture the developer attached to the first seal.

According to still another aspect of the invention, the first seal protrudes more outward than the first opening when the inside frame moves from the first opening position to the first closing position.

According thereto, when the inside frame moves from the first opening position to the first closing position, the first seal protrudes more outward than the first opening. Accordingly, the capturing member can reliably come in sliding contact with the first seal and capture the developer attached to the first seal. Since the first seal protrudes more outward than the first opening to intercept the space between the inside frame and the outside frame, it is possible to prevent the developer from leaking from the first opening between the inside frame and the outside frame.

What is claimed is:

1. A developing unit comprising:

a developer cartridge comprising:

an outside frame;

an inside frame that comprises a first opening opened toward outside of the inside frame and is movable between a first opening position where the first opening is opened and a first closing position where the first opening is closed by the outside frame; and a first seal disposed around the first opening on the inside frame;

a housing that comprises a cartridge holding part for holding the developer cartridge and is configured to hold a developer holding member; and a capturing member which is provided on the cartridge holding part, which has a developer capturing force greater than that of the first seal, and which is slide contactable with the first seal when the inside frame moves from the first opening position to the first closing position, wherein the first seal comprises a first contact portion that is contactable with the capturing member, wherein the capturing member comprises a second contact portion that is contactable with the first seal, and wherein a surface roughness of the second contact portion is greater than a surface roughness of the first contact portion on the basis of a ten-point average roughness.

2. The developing unit according to claim 1, wherein the second contact portion is formed of a foamed material, and wherein the first contact portion is formed of a non-foamed material.

3. The developing unit according to claim 1, wherein the developer is charged into a first polarity, and wherein the second contact portion is formed of a material having a polarity that is closer to a second polarity, which is opposite to the first polarity, than a polarity of a material of the first contact portion in a charging table.

4. The developing unit according to claim 1, further comprising a protrusion that is provided in a circumferential edge of the first opening of the inside frame with protruding outward from the inside frame, the protrusion being configured to press the first seal toward the capturing member.

5. The developing unit according to claim 1, wherein the first seal protrudes more outward than the first opening when the inside frame moves from the first opening position to the first closing position.

6. A developing unit comprising:

a developer cartridge comprising:

an outside frame;

an inside frame that comprises a first opening opened toward outside of the inside frame and is movable between a first opening position where the first opening is opened and a first closing position where the first opening is closed by the outside frame; and a first seal disposed around the first opening on the inside frame;

a housing that comprises a cartridge holding part for holding the developer cartridge and is configured to hold a developer holding member; and a capturing member which is provided on the cartridge holding part, which has a developer capturing force greater than that of the first seal, and which is slide contactable with the first seal when the inside frame moves from the first opening position to the first closing position, wherein the first seal comprises a first contact portion that is contactable with the capturing member, wherein the capturing member comprises a second contact portion that is contactable with the first seal, wherein the first contact portion is formed of a foamed material and comprises a plurality of first depressed portions exposed on a surface thereof, wherein the second contact portion is formed of the foamed material and comprises a plurality of second depressed portions exposed on a surface thereof, and wherein an average opening area of the second depressed portions is greater than an average opening area of the first depressed portions.

7. The developing unit according to claim 6, wherein an average depth of the second depressed portions is greater than an average depth of the first depressed portions.

8. The developing unit according to claim 6, wherein the average opening area S of the first depressed portions and an average particle size L of the developer satisfy the following relation:

$$2(S/\Pi)^{0.5} < L.$$

9. The developing unit according to claim 6, wherein the first seal and the capturing member are formed of the same material, and wherein a density of the capturing member is lower than that of the first seal.

10. A developing unit comprising:

a developer cartridge comprising:

an outside frame;

an inside frame that comprises a first opening opened toward outside of the inside frame and is movable between a first opening position where the first opening is opened and a first closing position where the first opening is closed by the outside frame; and a first seal disposed around the first opening on the inside frame;

a housing that comprises a cartridge holding part for holding the developer cartridge and is configured to hold a developer holding member; and a capturing member which is provided on the cartridge holding part, which has a developer capturing force greater than that of the first seal, and which is slide contactable with the first seal when the inside frame moves from the first opening position to the first closing position, wherein the first seal comprises:

a first portion that is contactable with the capturing member; and a second portion that is provided on an opposite side of the capturing member with respect to the first portion when the first portion contacts with the capturing member, the second portion having an elastic modulus that is smaller than an elastic modulus of the first portion.

11. A developing unit comprising:

a developer cartridge comprising:

an outside frame;

an inside frame that comprises a first opening opened toward outside of the inside frame and is movable between a first opening position where the first opening is opened and a first closing position where the first opening is closed by the outside frame; and a first seal disposed around the first opening on the inside frame;

a housing that comprises a cartridge holding part for holding the developer cartridge and is configured to hold a developer holding member; and a capturing member which is provided on the cartridge holding part, which has a developer capturing force greater than that of the first seal, and which is slide contactable with the first seal when the inside frame moves from the first opening position to the first closing position, wherein the housing comprises a second opening that is opened toward outside of the housing, and that faces the cartridge holding part and is locatable in a position opposed to the first opening when the inside frame is located at the first opening position, wherein the developing unit further comprises a second seal that is provided around the second opening and is configured to prevent the developer from leaking between the first opening and the second opening by making contact with the first seal, and wherein the second seal comprises the capturing member.

12. The developing unit according to claim 11, wherein a portion of the first seal more upstream than the first opening in a movement direction of the inside frame from the first opening position to the first closing position is exposed to the second opening when the inside frame moves from the first opening position to the first closing position and slide contacts with a portion of the capturing member more downstream than the second opening in the first movement direction.

13. The developing unit according to claim 12, wherein the movement direction is upward.

14. The developing unit according to claim 11, further comprising a shutter that is provided closer to the first opening than the capturing member with respect to the second opening in the housing and is movable between a second opening position where the second opening is opened and a second closing position where the second opening is closed, wherein, when the inside frame is located at the first opening position and the shutter is located at the second opening position, the first seal is contactable with the capturing member.

15. The developing unit according to claim 14, wherein the capturing member comprises a contact surface in a portion of the capturing member more downstream in a movement direction of the shutter from the second opening position to the second closing position than the second opening, the contact surface being contactable with an end of the shutter moving from the second opening position to the second closing position, wherein the contact surface extends to the second opening, wherein a contact pressure of the contact surface on the end of the shutter increases as the shutter moves from the second opening position to the second closing position, and wherein a portion of the housing supporting a portion of the capturing member corresponding to the contact surface is inclined toward the second opening as approaching upstream in the movement direction.

16. The developing unit according to claim 11, further comprising:

a shutter that is provided closer to the first opening than the capturing member with respect to the second opening in the housing and is movable between a second opening position where the second opening is opened and a second closing position where the second opening is closed; and a protruding portion that is provided in the shutter, an end thereof close to the first opening protruding more downstream in a movement direction of the shutter from the second opening position to the second closing position than the end close to the second opening.

17. The developing unit according to claim 16, wherein the capturing member comprises a contact surface in a portion of the capturing member more downstream in the movement direction of the shutter from the second opening position to the second closing position than the second opening, the contact surface being contactable with an end of the shutter moving from the second opening position to the second closing position, wherein the contact surface extends to the second opening, wherein a contact pressure of the contact surface on the end of the shutter increases as the shutter moves from the second opening position to the second closing position, and wherein a portion of the housing supporting a portion of the capturing member corresponding to the contact surface is inclined toward the second opening as approaching upstream in the movement direction.

* * * * *